US006601677B1

(12) United States Patent
Storm

(10) Patent No.: US 6,601,677 B1
(45) **Date of Patent: *Aug. 5, 2003**

(54) CONVERTIBLE LIFT MECHANISM HAVING A NUMBER OF RETRACTABLE STAIRS WITH A LIFT PLATFORM POSITIONED THEREUNDER

(75) Inventor: George L. Storm, Trotwood, OH (US)

(73) Assignee: Vertical Mobility, L.L.C., Dayton, OH (US)

( * ) Notice: Subject to any disclaimer, the term of this patent is extended or adjusted under 35 U.S.C. 154(b) by 6 days.

This patent is subject to a terminal disclaimer.

(21) Appl. No.: 09/648,773

(22) Filed: Aug. 28, 2000

Related U.S. Application Data

(63) Continuation-in-part of application No. 09/114,774, filed on Jul. 14, 1998, now Pat. No. 6,109,395.
(60) Provisional application No. 60/052,474, filed on Jul. 14, 1997.

(51) Int. Cl.[7] ..... B66B 9/08
(52) U.S. Cl. ..... 187/200; 414/921
(58) Field of Search ..... 187/200, 201, 187/245, 214, 267; 414/545, 921; 254/387, 120, 122

(56) References Cited

U.S. PATENT DOCUMENTS

| | | | | | |
|---|---|---|---|---|---|
| 2,270,735 | A | * | 1/1942 | Knudsen | 187/245 |
| 4,124,097 | A | | 11/1978 | Hawks et al. | 187/200 |
| 4,164,292 | A | | 8/1979 | Karkau | 414/921 |
| 4,168,134 | A | | 9/1979 | Pohl | 414/545 |
| 4,180,366 | A | | 12/1979 | Roth et al. | 414/921 |
| 4,251,179 | A | * | 2/1981 | Thorley | 414/921 |
| 4,270,630 | A | | 6/1981 | Karkau | 414/921 |
| 4,273,217 | A | | 6/1981 | Kajita | 187/200 |
| 4,285,416 | A | | 8/1981 | Dudynskyj | 187/200 |
| 4,347,030 | A | * | 8/1982 | Kingston | 414/921 |
| 4,457,402 | A | | 7/1984 | Del Vecchio et al. | 414/921 |
| 4,583,466 | A | | 4/1986 | Reddy et al. | 414/921 |
| 4,664,584 | A | * | 5/1987 | Braun et al. | 414/921 |
| 4,941,797 | A | | 7/1990 | Smillie, III | 187/269 |
| 5,154,569 | A | * | 10/1992 | Eryou et al. | 187/200 |
| 5,224,723 | A | | 7/1993 | Hatas | 414/921 |
| 5,234,078 | A | | 8/1993 | Smith | 187/200 |
| 5,316,432 | A | * | 5/1994 | Smalley et al. | 414/921 |
| 5,375,962 | A | * | 12/1994 | Kempf | 414/921 |
| 5,425,615 | A | * | 6/1995 | Hall et al. | 414/545 |
| 5,553,990 | A | * | 9/1996 | Kytotla, Sr. | 414/921 |
| 5,632,357 | A | | 5/1997 | Matre | 187/200 |
| 5,862,884 | A | * | 1/1999 | Smith | 187/200 |
| 5,865,593 | A | * | 2/1999 | Cohn | 414/545 |
| 5,901,812 | A | * | 5/1999 | Meunier | 414/921 |
| 5,901,813 | A | * | 5/1999 | Orgal | 187/200 |
| 5,937,971 | A | | 8/1999 | Storm | 187/200 |
| 6,050,366 | A | * | 4/2000 | Lyons | 187/200 |
| 6,062,805 | A | * | 5/2000 | Tremblay et al. | 414/921 |
| 6,109,395 | A | | 8/2000 | Storm | 187/200 |
| 6,435,804 | B1 | * | 8/2002 | Hutchins | 187/200 |

FOREIGN PATENT DOCUMENTS

| | | |
|---|---|---|
| JP | 4-95538 A | 3/1992 |

* cited by examiner

*Primary Examiner*—Eileen D. Lillis
*Assistant Examiner*—Paul T. Chin
(74) *Attorney, Agent, or Firm*—Maginot, Moore & Bowman

(57) ABSTRACT

A convertible lift mechanism for moving an object from a lower surface to a vertically displaced upper surface includes a number of retractable stairs. Each of the number of retractable stairs includes a stepping surface and is horizontally movable between a position received into an opening defined in a vertical wall between the upper and lower surfaces, and a position extending out of the opening. The convertible lift mechanism also includes a lift platform which is movable between a lowered position and a raised position. The convertible lift mechanism also includes a number of vertical screw drive mechanisms each including a driven lift nut that is secured to the lift platform. Actuation of the number of vertical screw drive mechanisms causes movement of the lift platform between the lowered position and the raised position. A method of operating a convertible lift mechanism is also disclosed.

18 Claims, 19 Drawing Sheets

CONVERTIBLE LIFT MECHANISM HAVING A NUMBER OF RETRACTABLE STAIRS WITH A LIFT PLATFORM POSITIONED THEREUNDER

This application is a continuation-in-part of U.S. patent application Ser. No. 09/114,774, filed on Jul. 14, 1998, now U.S. Pat. No. 6,109,395, entitled "Convertible Lift Mechanism Having A Scissor Lift Linkage" by George L. Storm.

TECHNICAL FIELD OF THE INVENTION

The present invention relates generally to the field of vertical lifts, and in particular, lift mechanisms that convert to stairs.

BACKGROUND OF THE INVENTION

Stairways employed in buildings and other structures present difficulties to non-ambulatory individuals. For example, a non-ambulatory individual confined to a personal vehicle such as a wheelchair cannot easily negotiate common stairwells. To accommodate such individuals, separate elevator lifts, moving chair arrangements, or ramps are often provided. In stair structures extending a vertical distance that is less than a building story, such as those typically used near the entrance to a building, a separate elevator lift is not always practical, particularly in outdoor environments. In such cases, separate ramps or moving chair arrangements may be provided which facilitate vertical travel by a personal vehicle.

One drawback to the use of a separate ramp to provide personal vehicle access to elevated surfaces is that suitable ramps consume relatively large amounts of space. As a result, existing buildings must often be substantially altered to accommodate the installation of a ramp. In many circumstances, space constraints surrounding the building make installation of a ramp impossible.

Moving chair arrangements offer a solution in such low rise environments. Moving chair arrangements comprise a chair that slides diagonally up and down the stair way. Such arrangements require that the personal vehicle be separately transported up or down the stairway. Because personal vehicles can be quite heavy, separate transport of the personal vehicle can be difficult. Moreover, the movable chair itself, when not in use, nevertheless occupies stairway space and dictates the appearance of the staircase.

Separate vertical wheelchair lifts have also been employed for such low rise environments for use in situations in which there is inadequate room for an access ramp. Such devices, however, while consuming less space than a ramp, nevertheless consume valuable access space and dictate architectural parameters. Moreover, separate wheelchair lifts may be impossible to implement in hallways or other narrow environments.

In an attempt to address some of the concerns of the separate vertical lift, lifts have been developed that cooperate with a staircase to provide a lift that fits within a hallway or narrow environment. For example, U.S. Pat. No. 4,457,402 to Del Vecchio et al. shows a lift that is disposed directly in front of a low rise staircase that extends from a lower surface to an upper surface. The lift provides vertical transport of wheelchairs from the lower surface to the level of the upper surface. When the lift rises, the stairs collapse upward to form a bridge platform that allows travel from the lift platform over the area normally occupied by the staircase to the destination upper surface.

Another proposed design of a lift that may be located in a hallway is found in U.S. Pat. No. 5,234,078 to Smith. In the Smith patent, the lift platform is normally located on the upper surface directly behind the ascending stairs. In other words, the lift platform forms a portion of the upper surface. The lift platform provides transport between the upper surface and the lower surface through vertical movement. When the lift platform lowers to the level of the lower surface, the stairs collapse so that they too are substantially on the level of the lower surface. When the lift platforms rises to the level of the upper surface, the stairs reconfigure into a staircase.

A drawback of the designs found in the Del Vecchio et al. and Smith patents discussed above is that they require space equivalent to the area of the lift platform either completely in front of or completely behind the staircase. In some cases, such area is not available. Moreover, because the lift platform is located completely outside the footprint of the staircase, the lift platform creates a potentially displeasing architectural discontinuity with the surface at which it normally rests while not in operation. For example, as shown in FIG. 1 of the Smith patent, the lift structure requires special wall and floor structures that create visible discontinuities along the floor and wall. Likewise, the lift shown in FIG. 1 of the Del Vecchio et al. patent undesirable creates a plainly visible discontinuity along the intersection of the platform and lower (ground) surface. Such discontinuities significantly affect the appearance of an architectural structure.

There exists a need, therefore, for a lift structure for providing access to personal vehicles between a lower surface and an upper surface that has reduced impact on the architectural and/or design aspects of a structure, and may be employed in structures with space constraints.

SUMMARY OF THE INVENTION

The present invention fulfills the above need, as well as others, by providing, in one embodiment, a convertible lift mechanism that employs a conversion stair that functions as a stair in one configuration and as a lift platform in another configuration. By employing a stair that converts into a lift platform, the lift platform need not be implemented as a totally separate structure that both occupies additional space and impinges upon the architectural integrity of a structure. In other embodiments, the lift platform is positioned below a number of retractable stairs. In either case, the convertible lift mechanism of the present invention includes a lift platform that occupies space that is already occupied by the staircase, thus requiring little or no additional space. Accordingly, the architectural integrity of the structure is left substantially intact.

In accordance with one embodiment of the present invention, there is provided a convertible lift mechanism for moving an object from a lower surface to a vertically displaced upper surface. The lower surface and the upper surface have a vertical wall interposed therebetween. The convertible lift mechanism includes a lift platform which is movable between (i) a lowered platform position in which the lift platform is positioned approximately level with the lower surface, and (ii) a raised platform position in which the lift platform is positioned approximately level with the upper surface. The convertible lift mechanism also includes a gate member pivotally secured to the lift platform. The gate member is positionable between (i) an extended gate position in which the gate member is orientated substantially parallel to the lift platform so as to form a bridging surface between the lower surface and the lift platform, and (ii) a retracted gate position in which the gate member is orientated substantially perpendicular to the lift platform so as to form a retaining surface for retaining the object on the lift platform. The convertible lift mechanism further includes a number of retractable stairs. Each of the number of retractable stairs includes a substantially horizontal stepping surface. Each of the number of retractable stairs is horizontally movable between (a) a retracted stair position in which the stepping surface is received into an opening defined in the vertical wall, and (b) an extended stair position in which the stepping surface extends out of the opening defined in the vertical wall.

In accordance with another embodiment of the present invention, there is provided a method of operating a convertible lift mechanism for moving an object from a lower surface to a vertically displaced upper surface. The lower surface and the upper surface have a vertical wall interposed therebetween. The convertible lift mechanism has (a) a lift platform, (b) a gate member pivotally coupled to the lift platform, and (c) a number of retractable stairs. The method includes the step of positioning the lift platform in a lowered platform position in which the lift platform is positioned approximately level with the lower surface. The method also includes the step of positioning the gate member in an extended gate position in which the gate member is orientated substantially parallel to the lift platform so as to form a bridging surface between the lower surface and the lift platform. The method further includes the step of positioning each of the number of retractable stairs in an extended stair position in which a stepping surface associated with each of the number of retractable stairs extends out of an opening defined in the vertical wall. In addition, the method includes the step of retracting the stepping surface of each of the number of retractable stairs into the opening defined in the vertical wall so as to position each of the number of retractable stairs into a retracted stair position. Yet further, the method includes the step of positioning the gate member in a retracted gate position in which the gate member is orientated substantially perpendicular to the lift platform so as to form a retaining surface for retaining the object on the lift platform. Moreover, the method includes the step of moving the lift platform from the lowered platform position to a raised platform position in which the lift platform is positioned approximately level with the upper surface.

In accordance with yet another embodiment of the present invention, there is provided a convertible lift mechanism for moving an object from a lower surface to a vertically displaced upper surface. The lower surface and the upper surface have a vertical wall interposed therebetween. The convertible lift mechanism includes a number of retractable stairs. Each of the number of retractable stairs includes a substantially horizontal stepping surface. Each of the number of retractable stairs is horizontally movable between (a) a retracted stair position in which the stepping surface is received into an opening defined in the vertical wall, and (b) an extended stair position in which the stepping surface extends out of the opening defined in the vertical wall. The convertible lift mechanism also includes a lift platform which is movable between (i) a lowered platform position in which the lift platform is positioned approximately level with the lower surface, and (ii) a raised platform position in which the lift platform is positioned approximately level with the upper surface. The convertible lift mechanism also includes a number of vertical screw drive mechanisms. Each of the number of vertical screw drive mechanisms includes a driven lift nut. Each of the driven lift nuts of the number of vertical screw drive mechanisms is secured to the lift platform. Actuation of the number of vertical screw drive mechanisms causes movement of the driven lift nuts thereby moving the lift platform between the lowered platform position and the raised platform position.

In accordance with a further embodiment of the present invention, there is provided a convertible lift mechanism for moving an object from a lower surface to a vertically displaced upper surface. The lower surface and the upper surface have a vertical wall interposed therebetween. The convertible lift mechanism includes a lift platform which is movable between (i) a lowered platform position in which the lift platform is positioned approximately level with the lower surface, and (ii) a raised platform position in which the lift platform is positioned approximately level with the upper surface. The convertible lift mechanism also includes a first retractable stair having a first substantially horizontal stepping surface. The first retractable stair is horizontally movable between (i) a first retracted stair position in which the first stepping surface is received into an opening defined in the vertical wall, and (ii) a first extended stair position in which the first stepping surface extends out of the opening defined in the vertical wall. The convertible lift mechanism further includes a second retractable stair having a second substantially horizontal stepping surface. The second retractable stair being horizontally movable between (i) a second retracted stair position in which the second stepping surface is received into the opening defined in the vertical wall, and (ii) a second extended stair position in which the second stepping surface extends out of the opening defined in the vertical wall. The convertible lift mechanism yet further includes a contact member secured to the first retractable stair. The contact member contacts the second retractable stair during movement of the first retractable stair from the first retracted stair position to the first extended stair position so as to urge the second retractable stair into the second extended stair position, and (ii) the contact member contacts the second retractable stair during movement of the first retractable stair from the first extended stair position to the first retracted stair position so as to urge the second retractable stair into the second retracted stair position.

The use of the convertible lift mechanisms of the present invention affords the ability to provide an alternative transport method at a stairway while requiring little or no additional space.

The above features and advantages, as well as others, will become more readily apparent to those of ordinary skill in the art by reference to the following detailed description and accompanying drawings.

DETAILED DESCRIPTION

Figure 1:
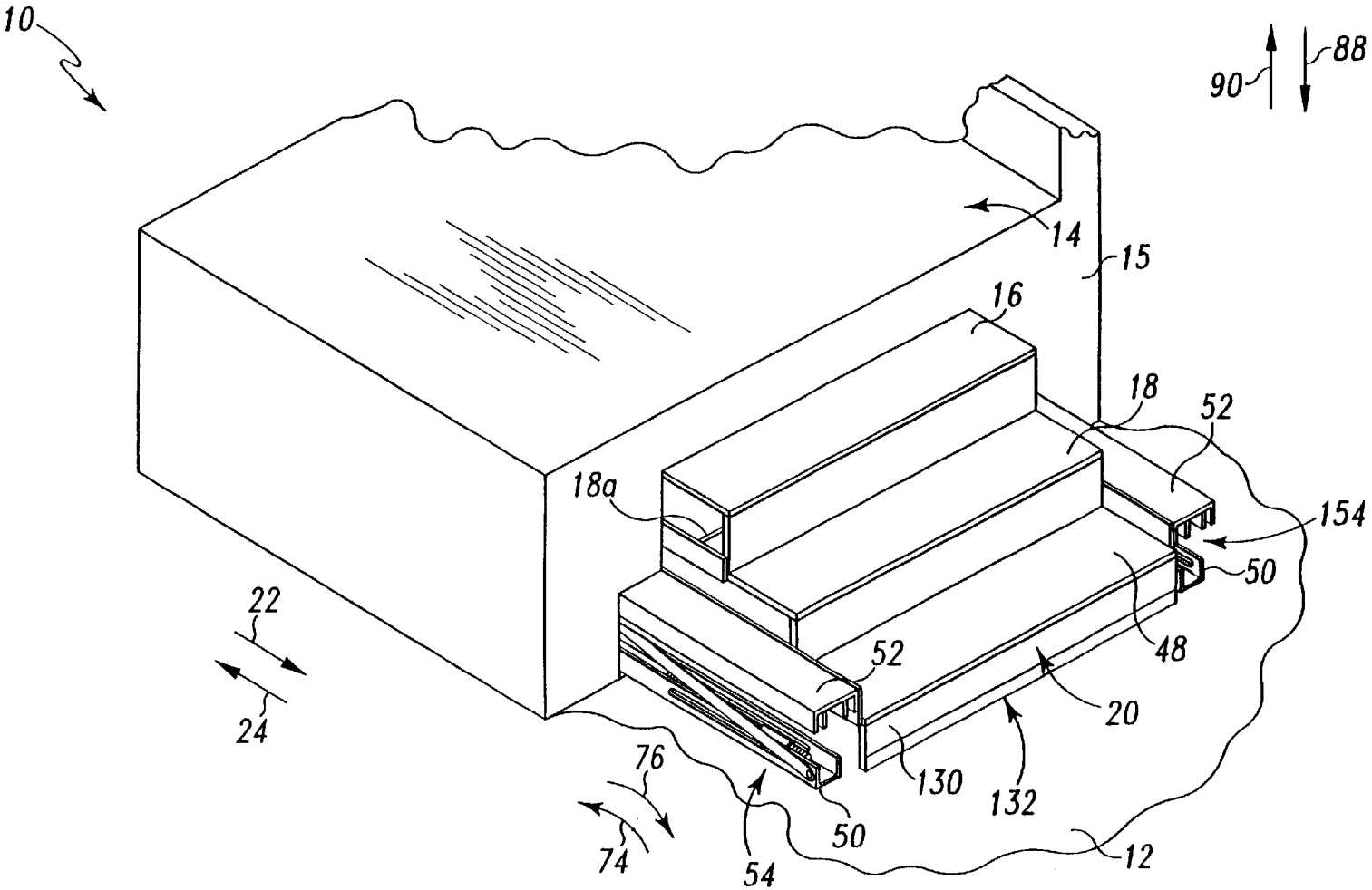
FIG. 1 is a perspective view of a convertible lift mechanism with a conversion stair in a first configuration which incorporates the features of the present invention therein.

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

Figure 1A:
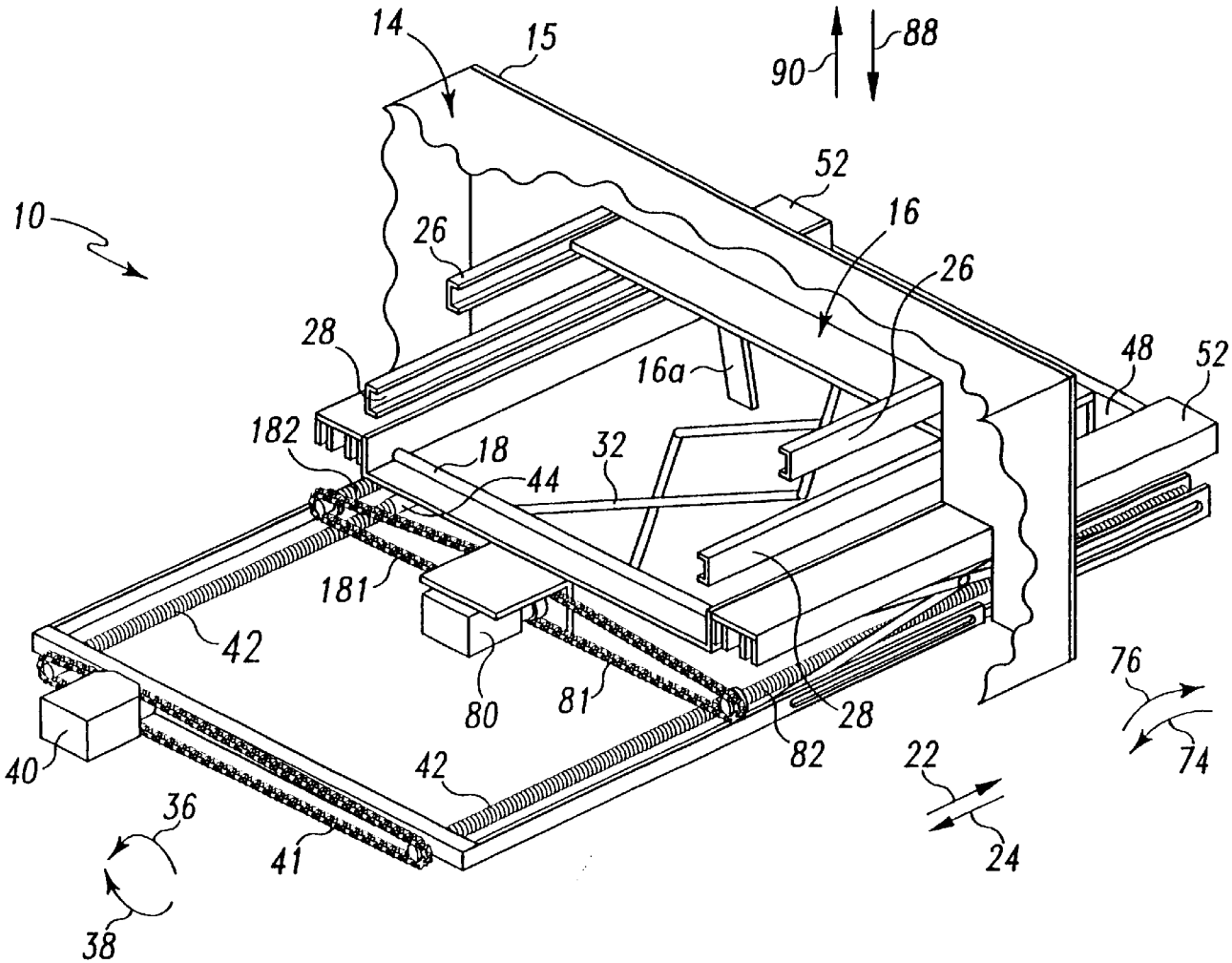
FIG. 1A is a rear perspective view of the convertible lift mechanism of FIG. 1.

FIGS. 1 and 1A show an exemplary embodiment of a convertible lift mechanism 10 according to the present invention that enables travel from a first or lower surface 12 and a second or upper surface 14. The convertible lift mechanism 10 includes a first retractable stair 16, a second retractable stair 18, a conversion stair 20, a source of motive power in the form of a motor 80, and scissor lift linkages 54 and 154.

In general, the convertible lift mechanism 10 has a first configuration and a second configuration. In the first configuration, as shown in FIGS. 1 and 1A and discussed in further detail below, the convertible lift mechanism operates as a stairway between the lower surface 12 and upper surface 14. In the second configuration, the convertible lift mechanism 10 operates as a vertical lift between the lower surface 12 and the upper surface 14.

Also shown in FIGS. 1 and 1A is a vertical wall 15, which extends from the lower surface 12 to the upper surface 14. It is noted that FIG. 1A is a cutaway perspective view in which the upper surface 14 is only shown in part in order to reveal structural features of the convertible lift mechanism 10 that are located under the upper surface 14.

In general, the conversion stair 20 includes a substantially horizontal surface 48 and a convertible riser 130. As will be discussed more fully below, a portion of the surface 48 operates as a stepping surface of a stair when the convertible lift mechanism 10 is in the first configuration (see FIG. 1). As with any stair, the portion of the surface 48 that operates as a stepping surface extends outward (and is horizontally positioned apart from) the upper surface 14, and is positioned vertically between the lower surface 12 and the upper surface 14. In the second configuration, however, the entire surface 48 operates as a lift platform that moves between a first position and a second position. The first position is at a vertical level that is approximately level with (i.e., within two inches of) the lower surface 12. The second position is more or less directly above the first position and is at a vertical level that is approximately level with the upper surface. Further details regarding the second configuration are provided further below in connection with FIGS. 3, 4, 5 and 5A.

Each of the first and second retractable stairs 16 and 18 includes a stepping surface and a riser, as would any stair. Each retractable stair 16 and 18, however, is also movable between an extended position that corresponds to the first configuration of the convertible lift mechanism 10 (see, e.g., FIG. 1) and a retracted position that corresponds to the second configuration (see, e.g. FIG. 3). In the extended position, the stepping surfaces of the retractable stairs 16 and 18 are disposed outward of the vertical wall to form ascending stairs. By contrast, in the retracted position, the stepping surfaces of the retractable stairs 16 and 18 are stowed completely underneath the upper surface 14 to permit vertical travel of the conversion stair 20 between the lower surface 12 and the upper surface 14. A more detailed description of the structure and operation of retractable stairs 16 and 18 is provided further below.

The source of motive power may suitably comprise an electric motor, such as the lift motor 80 (shown in FIG. 1A). However, alternative embodiments may employ alternative sources of motive power, such as, for example, a hydraulic lift system power source, a pneumatic piston system power source, and the like. Those of ordinary skill in the art may readily determine the appropriate type of motive power source for their particular implementation.

Each of the scissor lift linkages 54 and 154 is a linkage assembly that translates the motive force from the lift motor 80 to the conversion stair 20 to facilitate vertical movement of the surface 48 between the lower surface 12 and the upper surface 14. Further detail regarding the structure of the scissor lift linkages 54 and 154 is provided below in connection with FIGS. 3, 4, 5 and 5A.

Referring now specifically to FIG. IA, the first retractable stair 16 is slidingly secured to the building or facility under the upper surface 14 such that the first retractable stair 16 can move horizontally between the retracted position and the extended position. To this end, the first retractable stair 16 includes a plurality of wheels, not shown, which are received by a first set of rails 26. The first set of rails 26 are affixed to building or facility under the upper surface 14. The first retractable stair 16 moves via the plurality of wheels along the set of rails 26 in the general directions of arrows 22 and 24. The first retractable stair 16 also includes a vertical member 16*a* disposed vertically downward from the rear of its stepping surface.

Similarly, the second retractable stair 18 is also slidingly secured to the building or facility under the upper surface 14 such that the second retractable stair 18 can move horizontally between its extended position and its retracted position. To this end, the second retractable stair 16 also includes a plurality of wheels, not shown, which are received by a second set of rails 28 that are, in turn, affixed to the building or facility under the upper surface 14. The second retractable stair 18 includes a lip 18*a* extending vertically upward from the back edge of the stepping surface thereof. The lip 18*a* is advantageously configured to engage the vertical member 16*a* during retraction of the second retractable stair 18 and to engage the riser of the first retractable stair 16 during extension of the second retractable stair 18.

The convertible lift mechanism 10 further includes a retraction motor, not shown, that is mounted to the second retractable stair 18 underneath its stepping surface. The retraction motor and operatively coupled to the second retractable stair 18 so as to advance the second retractable stair 18 in the general directions of arrows 22 and 24. In particular, a retraction linkage 32 (shown in FIG. 1A) is coupled to the output shaft of the retraction motor through a lead screw or the like, not shown. The retraction linkage is also fixedly coupled at one end to a stationary member at the rear of the second retractable stair 18.

Referring again to the conversion stair 20, the convertible lift mechanism 10 further includes a positioning motor 40 that controls the horizontal location of the conversion stair 20. The horizontal location of the conversion stair 20 in the embodiment described herein differs in the first configuration and the second configuration. In particular, in order to provide an appropriately proportioned staircase when in the first configuration, the conversion stair 20 must be partially retracted such that a portion of the surface 48 is disposed underneath the upper surface 14. As will be discussed below, the conversion stair 20 in the second configuration is fully extended such that the entire surface 48 is outward of the vertical wall 15.

To this end, the positioning motor 40 is secured underneath the upper surface 14 and is operatively coupled to the conversion stair 20 so as to advance the conversion stair 20 in the general directions of arrows 22 and 24. To this end, a pair of positioning shafts 42 (shown in FIG. 1A) are coupled to the output shaft of the positioning motor 40 by a chain 41. Each of the positioning shafts 42 includes a lead screw and thus has a set of threads defined on the outer surface thereof. The conversion stair 20 includes two positioning nuts 44, each of which is threadingly engaged to the threads of each of the positioning shafts 42. The conversion stair 20 further includes as set of wheels (not shown) that engage the lower surface 12. The wheels facilitate translation of the conversion stair 20 along the first surface 12 in the general direction of arrows 22 and 24.

Figure 3:
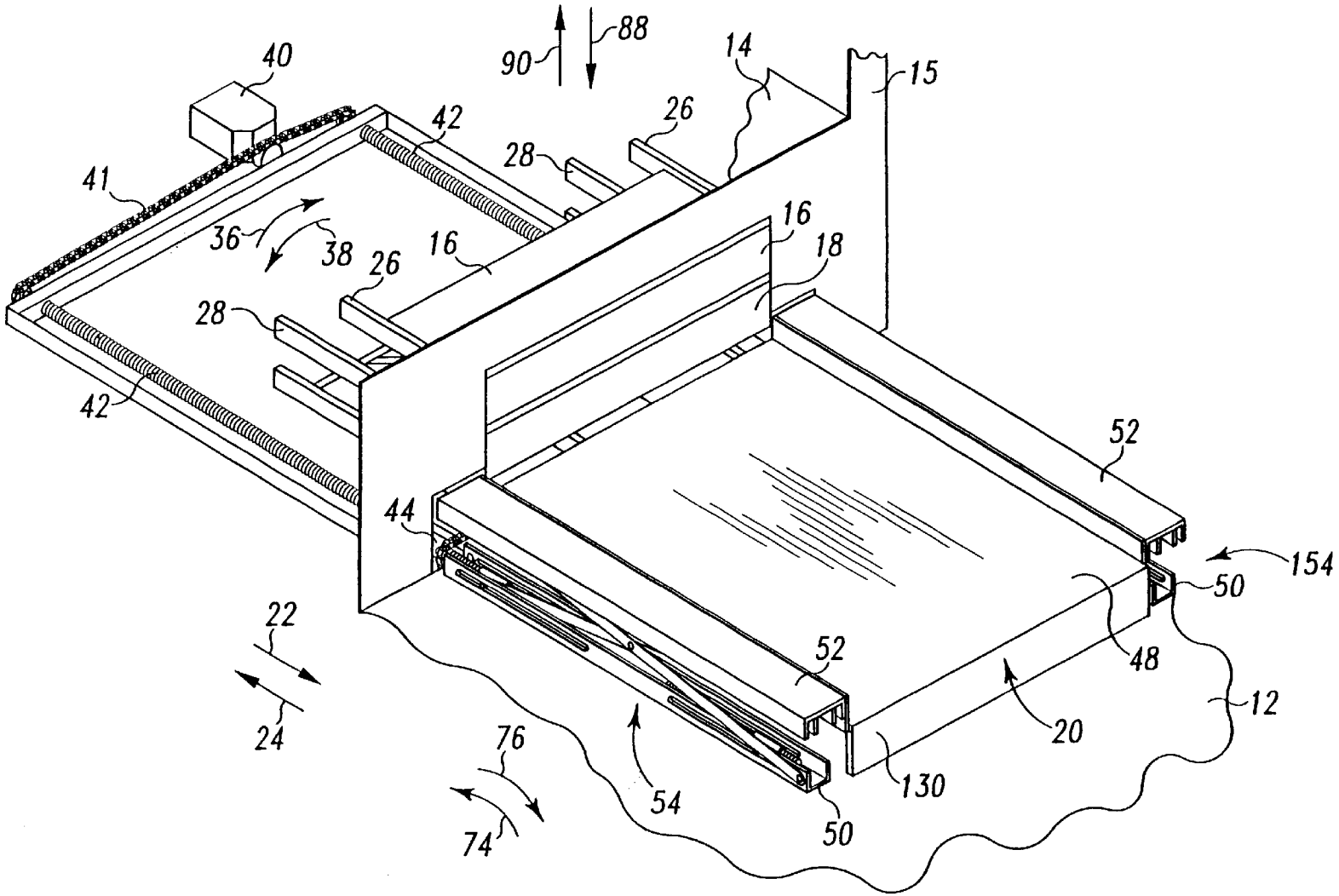
FIG. 3 is a perspective view of the convertible lift mechanism of FIG. 1 showing the conversion stair in a fully extended position.
Figure 4:
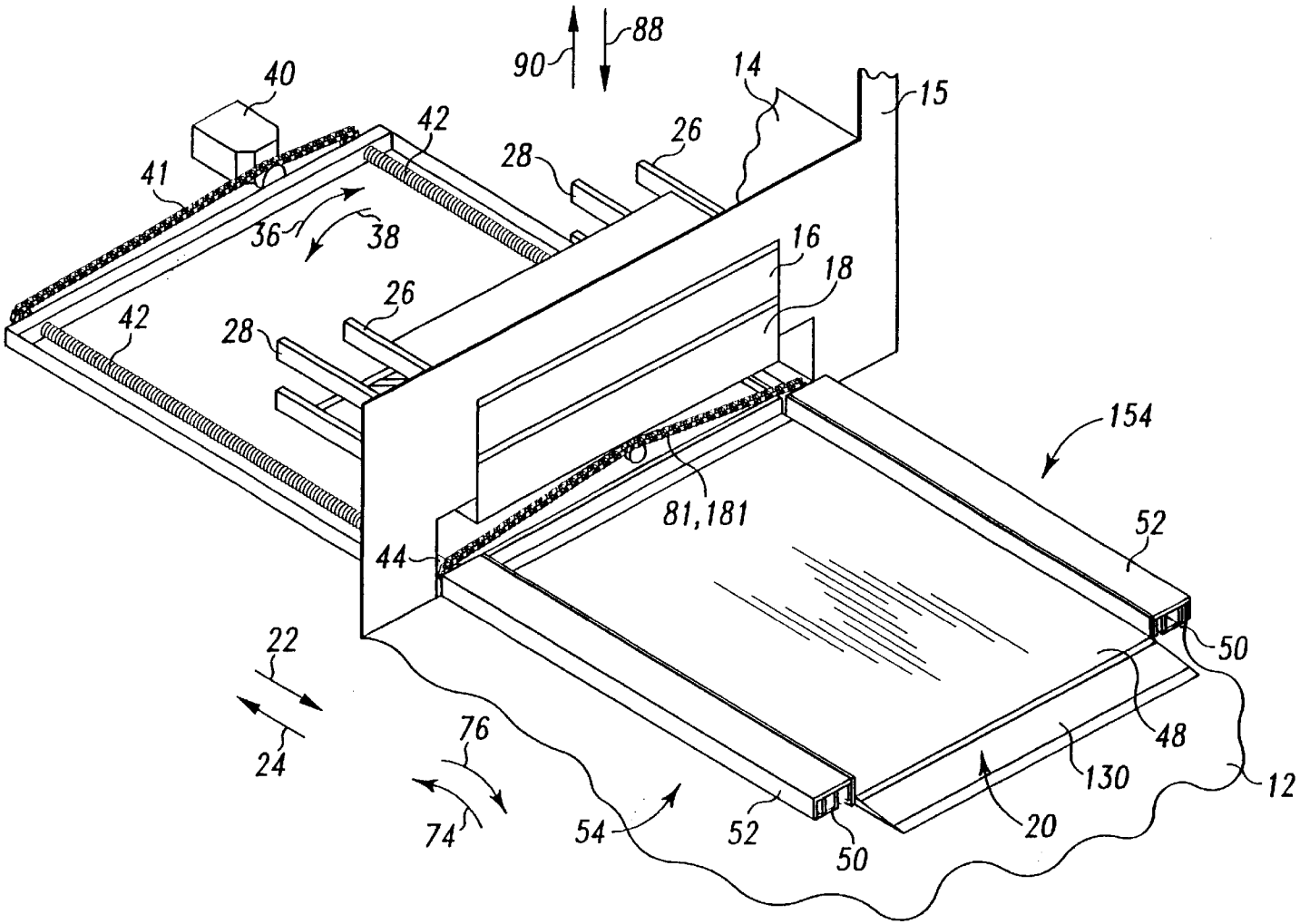
FIG. 4 is a perspective view of the convertible lift mechanism of FIG. 1 showing the horizontal lift surface of the conversion stair in the first position.
Figure 5:
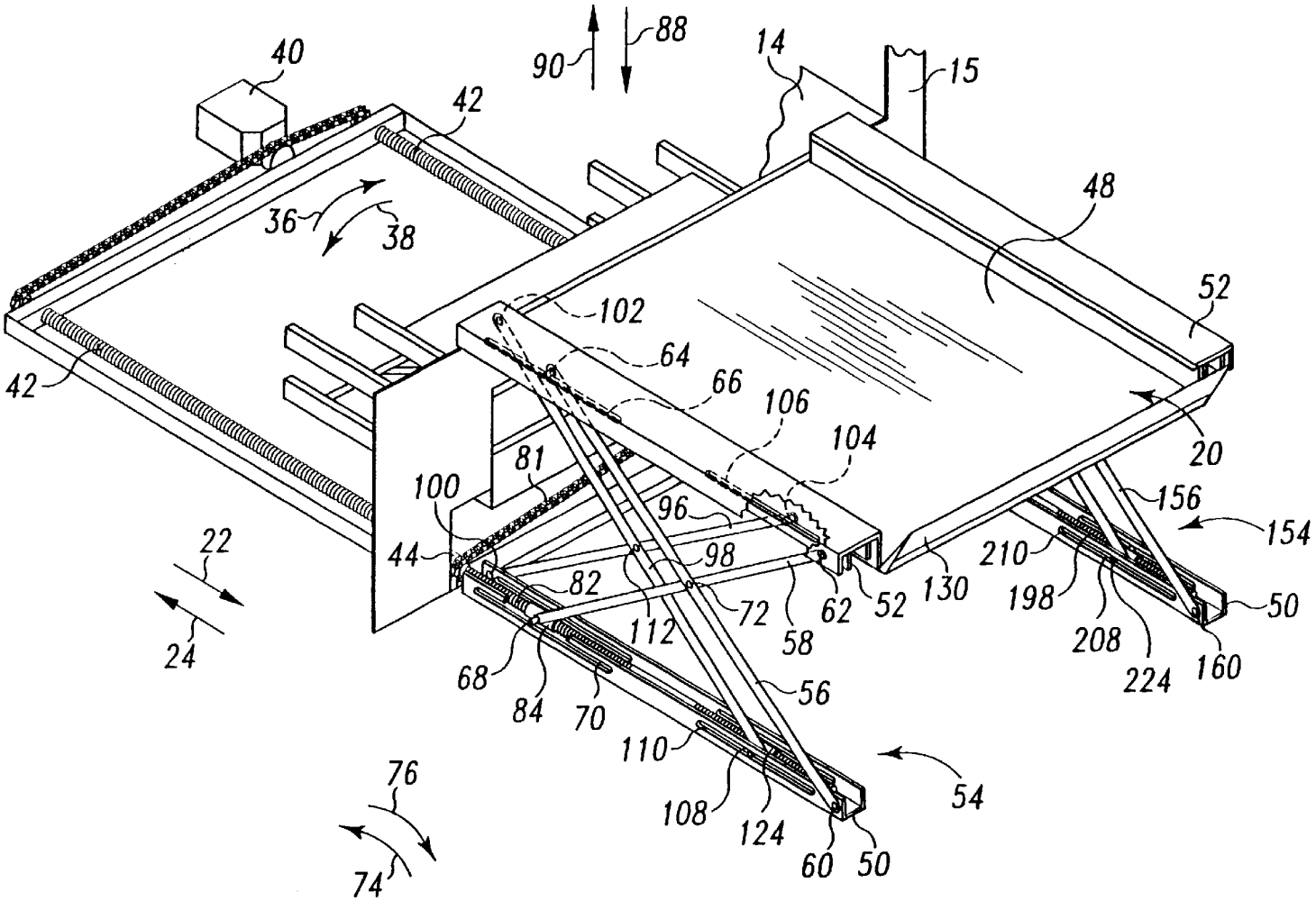
FIG. 5 is a perspective view of the convertible lift mechanism of FIG. 1 showing a horizontal lift surface in the second position.

FIGS. 3, 4, and 5 show the convertible lift mechanism wherein the conversion stair 20 in various stages of operation within the second configuration. As a result, certain structures of the convertible lift mechanism 10 are more clearly revealed in FIGS. 3 through 5. Accordingly, reference is now made generally to FIGS. 3 4, 5 and 5A to describe further structural details of the present embodiment.

The conversion stair 20 includes two upper supports 52. Each of the upper supports 52 comprises a beam having a U-shaped cross section. The upper supports 52 co-extend with and are secured to each side of the surface 48. The convertible lift mechanism 10 also includes two lower frame members 50 disposed below each of the upper supports 52. The first scissor lift linkage 54 is disposed between one of the upper supports 52 and a corresponding one of the lower frame members 50. The second scissor lift linkage 154 is disposed between the other upper support 52 and the corresponding other lower frame member 50.

In the exemplary embodiment described herein, the first scissor lift linkage 54 includes a first front diagonal linkage 56 and a second front diagonal linkage 58. A first end of the first front diagonal linkage 56 is pivotally coupled to the lower frame member 50 by a pin 60. The pin 60 is fixedly coupled to the lower frame member 50. The other end of the first front diagonal linkage 56 is pivotally coupled to a pin 64 which is received in a slot 66 defined in the upper support 52. In contrast to the pin 60, the pin 64 is slidably coupled to the upper support 52 such that the first front diagonal linkage 56 can translate in the general direction of arrows 22 and 24 relative to the upper support 52.

Similarly, the second front diagonal linkage 58 is pivotally coupled to the upper frame 52 by a pin 62. The pin 62 is fixedly secured to the upper frame. The other end of the second front diagonal linkage 58 is pivotally coupled to a pin 68 which is received in a slot 70 defined in the lower frame member 50 such that the pin 68 and the second front diagonal linkage 58 can translate in the general direction of arrows 22 and 24.

The first front diagonal linkage 56 and the second front diagonal linkage 58 are pivotally coupled to one another by a pin 72 such that the second front diagonal linkage 58 can rotate relative to the first front diagonal linkage 56 in the general directions of arrows 74 and 76.

The second front diagonal linkage 58 is also operably coupled to the lift motor 80. In particular, the lift motor 80, which is secured to the lower frame members 50, is operatively coupled by a chain 81 to two lift shafts 82 and 182. Each of the lift shafts 82 and 182 comprises a lead screw and thus has a set of threads defined on the outer surface thereof. The second front diagonal linkage 58 includes or is secured to a lift nut 84 which is threadingly engaged to the threads of the lift shaft 82.

The first scissor lift linkage 54 further includes first rear diagonal linkage 96 and a second rear diagonal linkage 98. A first end of the first rear diagonal linkage 96 is pivotally coupled to the lower frame member 50 by a pin 100. The other end of the first rear diagonal linkage 96 is pivotally coupled to a pin 104. The pin 104 is slidably coupled to the upper support 52 within a slot 106 defined therein such that the first rear diagonal linkage 96 can translate in the general direction of arrows 22 and 24.

Likewise, the second rear diagonal linkage 98 is pivotally coupled to the upper support 52 by a pin 102. The other end of the second rear diagonal linkage 98 is pivotally coupled to a pin 108 which is recieved in a slot 110 that is defined in the lower frame member 50, such that the second rear diagonal linkage 98 can translate in the general direction of arrows 22 and 24 relative to the lower frame member 50. The first rear diagonal linkage 96 and the second rear diagonal linkage 98 are pivotally coupled to each other by a pin 112 such that the second rear diagonal linkage 98 can rotate relative to the first rear diagonal linkage 96 in the general directions of arrows 74 and 76.

A lift nut 124 is threadingly engaged to the threads of the lift shaft 82 and secured to the pin 108 of the second rear diagonal linkage 98. It should be noted that the lift nut 124 is threaded in the opposite direction of the threads of the lift nut 84 of the second front diagonal linkage 58. Accordingly, as the lift nut 84 advances in the general direction of arrow 22, the lift nut 124 advances in the general direction of arrow 24 whereas as the lift nut 84 advances in the general direction of arrow 24, the lift nut 124 advances in the general direction of arrow 22.

As the lift motor 80 rotates the lift shaft 82 in the general direction of arrow 36, the lift nut 124 advances along the lift shaft 82 in the general direction of arrow 24 so as to urge the lift nut 124 and the pin 108 in the general direction of arrow 24.

Figure 5A:
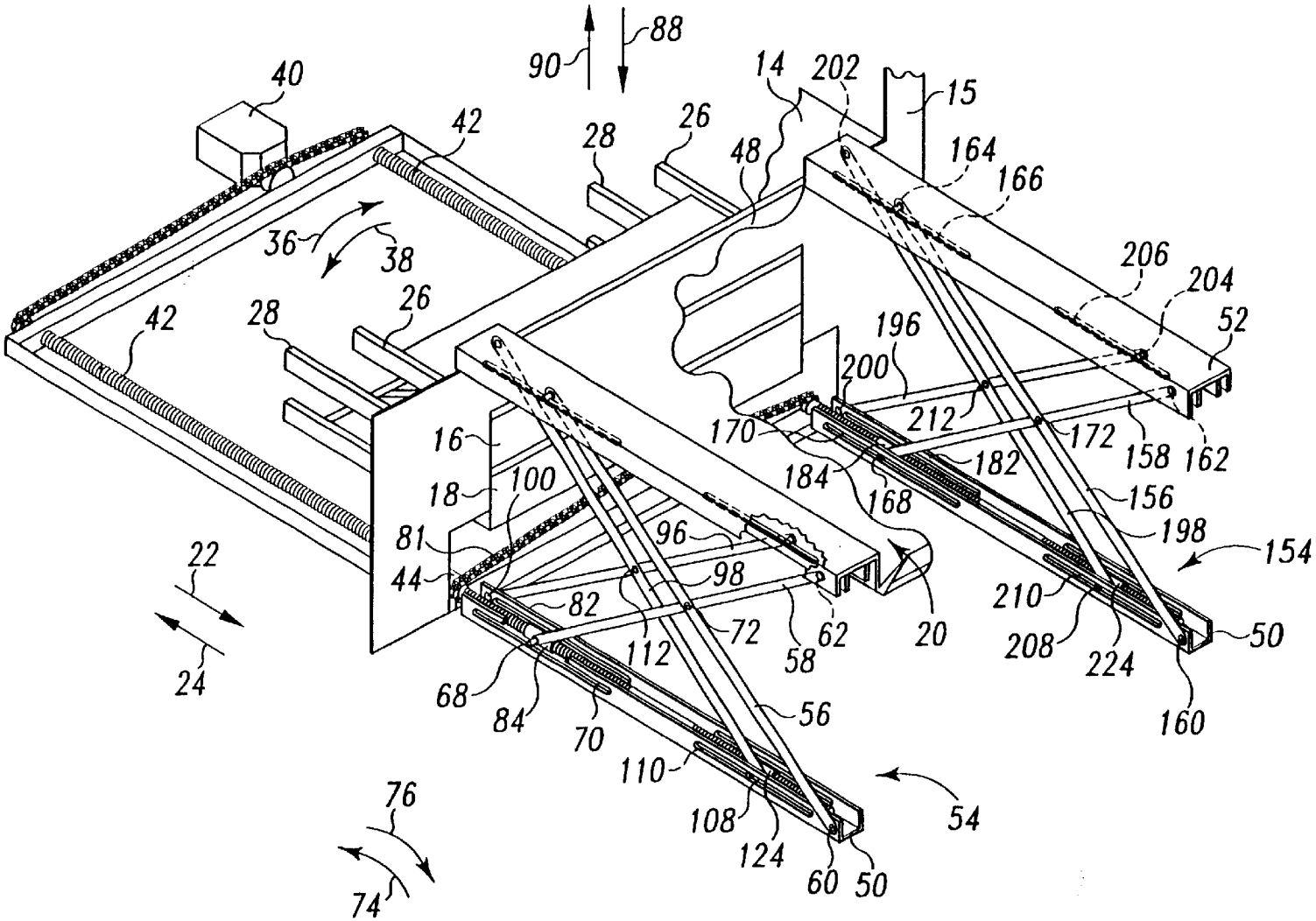
FIG. 5A is a view similar to FIG. 5, but having a portion of the horizontal lift surface cut away for clarity of description.

Referring now specifically to FIG. 5A, the second scissor lift linkage 154 is configured to cooperate with the first scissor lift linkage 54 to translate the motive force of the lift motor 80 to vertical travel of the conversion stair 20. To accomplish this, the second scissor lift linkage 154 further includes, among other things, a third front diagonal linkage 156 and a fourth front diagonal linkage 158.

A first end of the third front diagonal linkage 156 is pivotally coupled to the lower frame member 50 by a pin 160. The other end of the third front diagonal linkage 156 is pivotally coupled to a pin 164 which is received in a slot 166 defined in the upper support 52 such that the third front diagonal linkage 156 can translate in the general direction of arrows 22 and 24.

Likewise, the fourth front diagonal linkage 158 is pivotally coupled to the upper support 52 by a pin 162. The other end of the fourth front diagonal linkage 158 is pivotally coupled to a pin 168 which is received in a slot 170 that is defined in the lower frame member 50 such that the fourth front diagonal linkage 158 can translate in the general direction of arrows 22 and 24. The third front diagonal linkage 156 and the fourth front diagonal linkage 158 are pivotally coupled to each other by a pin 172 such that the fourth front diagonal linkage 158 can pivotally move relative to the third front diagonal linkage 156 in the general directions of arrows 74 and 76.

The fourth front diagonal linkage 158 is also operable coupled to the lift motor 80. In particular, the lift motor 80 is operatively coupled by a chain 181 to the lift shaft 182 (shown in FIG. IA) which comprises a lead screw and thus has a set of threads defined on the outer surface thereof. A lift nut 184 is threadingly engaged to the threads of the lift shaft 182 and is secured to the pin 168 of the fourth front diagonal linkage 158.

The second scissor lift linkage 154 further includes third rear diagonal linkage 196 and a fourth rear diagonal linkage 198. A first end of the third rear diagonal linkage 196 is pivotally coupled to the lower frame member 50 by a pin 200. The other end of the third rear diagonal linkage 196 is pivotally coupled to a pin 204 which is received in a slot 206 that is defined in the upper support 52 such that the third rear diagonal linkage 196 can translate in the general direction of arrows 22 and 24.

Similarly, the fourth rear diagonal linkage 198 is pivotally coupled to the upper support 52 by a pin 202. The other end of the fourth rear diagonal linkage 198 is pivotally coupled to a pin 208 which is recieved in a slot 210 that is defined in the lower frame member 50 such that the fourth rear diagonal linkage 198 can translate in the general direction of arrows 22 and 24. The third rear diagonal linkage 196 is pivotally coupled to the fourth rear diagonal linkage 198 by a pin 212.

A lift nut 224 is threadingly engaged to the threads of the lift shaft 182 and secured to the pin 208 of the fourth rear diagonal linkage 198. It should be noted that the lift nut 224 is threaded in the opposite direction than the lift nut 184 such that as the lift nut 184 advances in the general direction of arrow 22, the lift nut 224 advances in the general direction of arrow 24 whereas as the lift nut 184 advances in the general direction of arrow 24, the lift nut 224 advances in the general direction of arrow 22.

The convertible lift mechanism 10 further includes a convertible riser 130 pivotally secured to the upper support 52 support such that the convertible riser 130 can rotate in the general direction of arrows 74 and 76 relative to the upper support 52. The convertible riser 130 has three modes of operation. In the first mode of operation, the convertible riser 130 functions as a step riser. In the second mode of operation, the convertible riser 130 functions as a vehicle ramp. In the third mode of operation, the convertible riser 130 functions as a safety guard.

When the conversion stair 20 is in the first configuration, i.e. the conversion stair 20 is being used as a stair, the convertible riser 130 is in a first mode of operation whereby the convertible riser 130 is positioned such that an end 132 of the convertible riser 130 is oriented downwardly in the general direction of arrow 88 from the upper support 52 as shown in FIGS. 1, 1A, 2 and 6A. So oriented, the convertible riser 130 acts as a step riser to prevent a persons foot from advancing too far in the general direction of arrow 24.

Figure 6C:
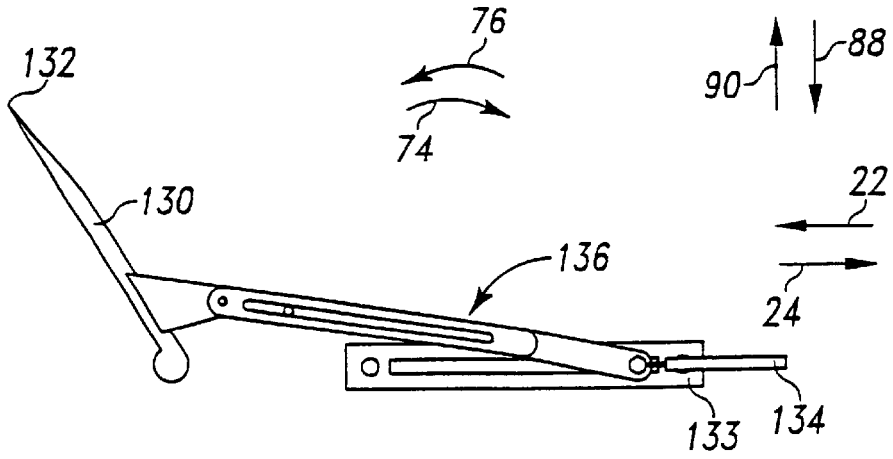
FIG. 6C a view similar to FIG. 6A, but showing the convertible riser in a third mode of operation.
Figure 6B:
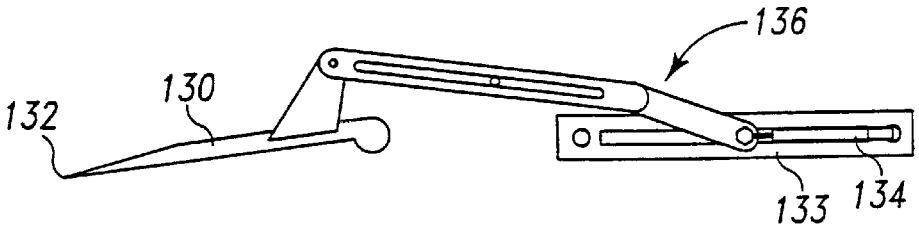
FIG. 6B a view similar to FIG. 6A, but showing the convertible riser in a second mode of operation.

When the conversion stair 20 is in the second configuration and the horizontal lifting surface 48 is approximately level with the lower surface 12, the convertible riser 130 is positioned in a second mode of operation shown in FIGS. 4 and 6B. In the second mode of operation, the convertible riser 130 extends substantially horizontally outward. When the convertible riser 130 is in the second mode of operation, the convertible riser 130 functions as a ramp between the lower surface 12 and the horizontal lifting surface 48 there by allowing a wheelchair or other personal vehicle to move between the first surface 12 to the horizontal lifting surface 48.

The third mode of operation shown in FIGS. 5, 5A and 6C. In the third mode of operation, the convertible riser 130 is oriented substantially vertically in the general direction of arrow 90 from the surface 48. In the third mode of operation, the convertible riser 130 functions as a safety guard to prevent a personal vehicle from accidentally moving in the general direction of arrow 22 beyond the edge of the horizontal lifting surface 48. The convertible riser 130 is positioned in the third mode of operation at any time the conversion stair 20 is being used to move a personal vehicle between the first position to the second position.

Figure 6A:
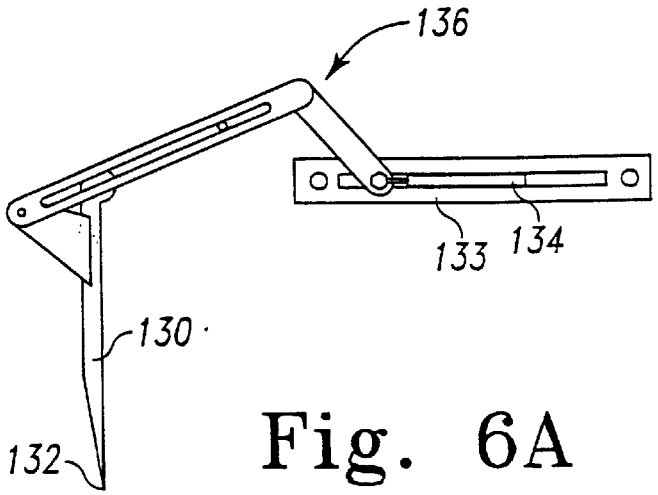
FIG. 6A a side elevation view of a convertible riser secured to the horizontal lift surface of FIG. 5 in a first mode of operation.

Referring now to FIGS. 6A, 6B, and 6C, to position the convertible riser 130, an actuator 134 is provided to move a linkage 136 relative to a support member 133 secured to the horizontal lift surface 48. In particular, as the actuator 134 is extended the farthest amount in the direction of arrow 24, the convertible riser 130 is positioned in the first mode of operation shown in FIG. 6A. When the actuator 134 is positioned in an intermediate position, the convertible riser 130 is positioned in the second mode of operation as shown in FIG. 6B. When the actuator 134 is positioned in the fully retracted position, the convertible riser 130 is positioned in the third mode of operation.

It should be appreciated that each of the lift motor 80, positioning motor 40, and retracting motor 30 may either (i) be stepper motors allow precise control over the rotation of the respective shafts, or (ii) may also include limit switches which deactivate a respective motor when the motor has moved a respective object to the desired position. Both configurations allow the precise control needed in the present invention and are well known to those skilled in the art. A control circuit, which may suitably microprocessor-based, is also included to control the operations of the various motors and activators. Those of ordinary skill in the art may readily devise a suitable control circuit.

In operation, the default configuration of the convertible lift mechanism 10 is the first configuration, shown in FIG. 1, in which the convertible lift mechanism 10 functions as a set of stairs. To transport a personal vehicle from the lower level 12 to the upper level 14, or vice versa, the conversion stair 20 must convert to its second configuration in which the convertible lift mechanism 10 can be used as a platform lift.

To convert the conversion stair 20 from the first configuration to the second configuration, the first retractable stair 16 and the second retractable stair 18 are first moved into the retracted position. To this end, the retraction motor is activated to rotate in a first direction. As the retraction motor rotates in a first direction, the retraction linkage 32 contracts. As the retraction linkage contracts 32, the second retractable stair 18 is urged in the general direction of arrow 24.

As the second retractable step 18 retracts, the lip I 8a thereon engages the vertical member 16a of the first retractable step 16. Accordingly, the continued movement of the second retractable stair 18 also urges the first retractable stair 16 in the general direction of arrow 24. Once both the first retractable step 16 and the second retractable step 18 in the retracted position shown in FIG. 2, the retraction motor stops.

Thereafter, or alternatively, contemporaneously, the conversion stair 20 moves from its partially retracted position to its fully extended position. To move the conversion stair 20 from the partially retracted position (shown in FIG. 2) to the fully extended position (shown in FIG. 3), the positioning motor 40 is activated to rotate in the general direction of arrow 36.

As the positioning motor 40 rotates the positioning shafts 42 in the general direction of arrow 36, the positioning nuts 44 advance along the respective positioning shaft 42 in the general direction of arrow 22 so as to urge the conversion stair 20 in the general direction of arrow 22 which moves the conversion stair 20 from the partially retracted position to the fully extended position.

Once the conversion stair 20 is fully extended and the first retractable stair 16 and second retractable stair 18 are in the retracted position, the convertible lift mechanism 10 is in the second configuration as shown in FIG. 3.

To allow the personal vehicle to move to the horizontal lift surface 48 of the conversion stair 20, the surface 48 of the conversion stair 20 must be lowered to its first position (shown in FIG. 4) which is approximately level with the lower surface 12. It is noted that because of the physical structural limitations of the conversion stair 20, the surface 48 will typically be slightly above the lower surface 12.

To lower the horizontal lift surface 48, the lift motor 80 rotates the lift shafts 82 and 182 in the general direction of arrow 38, which lowers the upper support 52 and the surface 48 until the surface 48 is at the first position approximately level with the first surface 12.

In particular, as the lift motor 80 rotates the lift shaft 82 in the general direction of arrow 38, the lift nut 84 on the first scissor lift linkage 54 advances along the lift shaft 82 in the general direction of arrow 24 so as to urge the lift nut 84 and the pin 68 in the general direction of arrow 24. As the pin 68 is urged in the general direction of arrow 24, the second front diagonal linkage 58 pivots in the general direction of arrow 76 about the pin 72, which urges the pin 62 and thus the upper support 52 in the general direction of arrow 88.

In a similar manner, rotation of the lift shaft 82 in the general direction of arrow 38 causes the first front diagonal linkage 56 to pivot in the general direction of arrow 74 about the pin 72. Such pivotal movement urges the pin 64 and thus the upper support 52 in the general direction of arrow 88.

Contemporaneously, as the lift motor 80 rotates the lift shaft 82 in the general direction of arrow 38, the lift nut 124 of the first scissor lift linkage 54 advances along the lift shaft 82 in the general direction of arrow 22 so as to urge the lift nut 124 and the pin 108 in the general direction of arrow 22. As the pin 108 is urged in the general direction of arrow 22, the second rear diagonal linkage 98 pivots in the general direction of arrow 74 about the pin 72 which urges the pin 102 and thus the upper support 52 in the general direction of arrow 88.

In a similar manner, rotation of the lift shaft 82 in the general direction of arrow 38 causes the first rear diagonal linkage 96 to pivot in the general direction of arrow 76 about the pin 72. Such pivotal movement urges the pin 104 and thus the upper support 52 in the general direction of arrow 88.

The various linkages of the second scissor lift linkage 154 operate in an analogous manner. Thus, when the lift motor 80 rotates the lift shaft 82 in the general direction of arrow 38, the upper support 52 is lowered in the general direction of arrow 88. It should be appreciated that lowering the upper support 52 in the general direction of arrow 88 also lowers the lifting surface 48 in the general direction of arrow 88.

In addition, as the surface 48 is lowered, the convertible riser 130 is moved from a first mode of operation (shown in FIG. 3) where the convertible riser 130 functions as a step riser to a second mode of operation (shown in FIG. 4) where the convertible riser 130 functions as a ramp. To this end, the actuator 134 is partially retracted until the convertible riser 130 extends substantially horizontally outward from the surface 48.

Once the horizontal lift surface 48 reaches the first position, a personal vehicle may be advanced from the first surface 12 to the horizontal lift surface 48 in the general direction of arrow 24 via the convertible riser 130. After the personal vehicle is positioned on the surface 48, the convertible riser 130 is moved from the second mode of operation to a third mode of operation (shown in FIGS. 5 and 5A) where the convertible riser 130 functions as a safety guard to prevent the personal vehicle from advancing in the general direction of arrow 22. To this end, the actuator 134 retracts fully to cause the convertible riser 130 to extend angularly upward from the surface 48.

The convertible lift mechanism 10 then moves the lift surface 48 vertically from the lower surface 12 to the upper surface 14. To move the horizontal lift surface 48 from the lower surface 12 to the upper surface 14, the lift motor 80 is actuated to rotate the lift shafts 82 and 182 in the general direction of arrow 36, which raises the upper support 52 and the horizontal lift surface 48 until the horizontal lift surface 48 is in the second vertical level adjacent to the second surface 14.

In particular, as the lift motor 80 rotates the lift shaft 82 in the general direction of arrow 36, the lift nut 84 of the first scissor lift linkage 54 advances along the lift shaft 82 in the general direction of arrow 22 so as to urge the lift nut 84 and the pin 68 in the general direction of arrow 22. As the pin 68 is urged in the general direction of arrow 22, the second front diagonal linkage 58 pivots in the general direction of arrow 74 about the pin 72, which urges the pin 62 and thus the upper support 52 in the general direction of arrow 90. In a similar manner, rotation of the lift shaft 82 in the general direction of arrow 36 causes the first front diagonal linkage 56 to pivot in the general direction of arrow 76 about the pin 72 such pivotal movement urges the pin 68 and thus the upper support 52 in the general direction of arrow 90.

Likewise, as the lift shaft 82 rotates in the general direction of arrow 36, the lift nut 124 and the corresponding pin 108 is urged in the general direction of arrow 24. The pin 108 is urged in the general direction of arrow 24, the second rear diagonal linkage 98 pivots in the general direction of arrow 74 about the pin 72 which urges the pin 102 and thus the upper support 52 in the general direction of arrow 90. In a similar manner, rotation of the lift shaft 82 in the general direction of arrow 36 causes the first rear diagonal linkage 96 to pivot in the general direction of arrow 74 about the pin 72. Such pivotal movement urges the pin 104 and thus the upper support 52 in the general direction of arrow 90.

The second scissor lift linkage 154 operates in an analogous manner to urge the upper support 52 in the general direction of arrow 90. Thus, when the lift motor 80 rotates the lift shaft 82 in the general direction of arrow 36, the upper support 52 is raised in the general direction of arrow 90. It should be appreciated that raising the upper support 52 in the general direction of arrow 90 raises the lifting surface 48 in the general direction of arrow 90.

Once the surface 48 reaches the second position, the lift motor 80 stops. Thereafter, the personal vehicle may be advanced from the horizontal lift surface 48 to the second position or upper surface 14 to complete the transfer of the personal vehicle from the lower surface 12 to the upper surface 14.

After the transfer of the personal vehicle from the first surface 12 to the second surface 14, the conversion stair 20 must be returned to the default or first configuration so that the convertible lift mechanism 10 may again function as a stairway. To return the horizontal lift surface 48 of the conversion stair 20 to the intermediate vertical position, the horizontal lift surface 48 must be lowered to the position shown in FIG. 3. The convertible lift mechanism 10 repeats the operations described above to lower the horizontal lift surface 48 back to the intermediate position between the first position and the second position, which is shown in FIG. 2.

In addition, as the horizontal surface 48 is lowered, the convertible riser 130 is moved from the third mode of operation (shown in FIGS. 5 and 5A) where the convertible riser 130 functions as a safety guard to the first mode of operation (shown in FIG. 3) where the convertible riser 130 functions as a step riser. To this end, the activator 134 fully extends.

Figure 2:
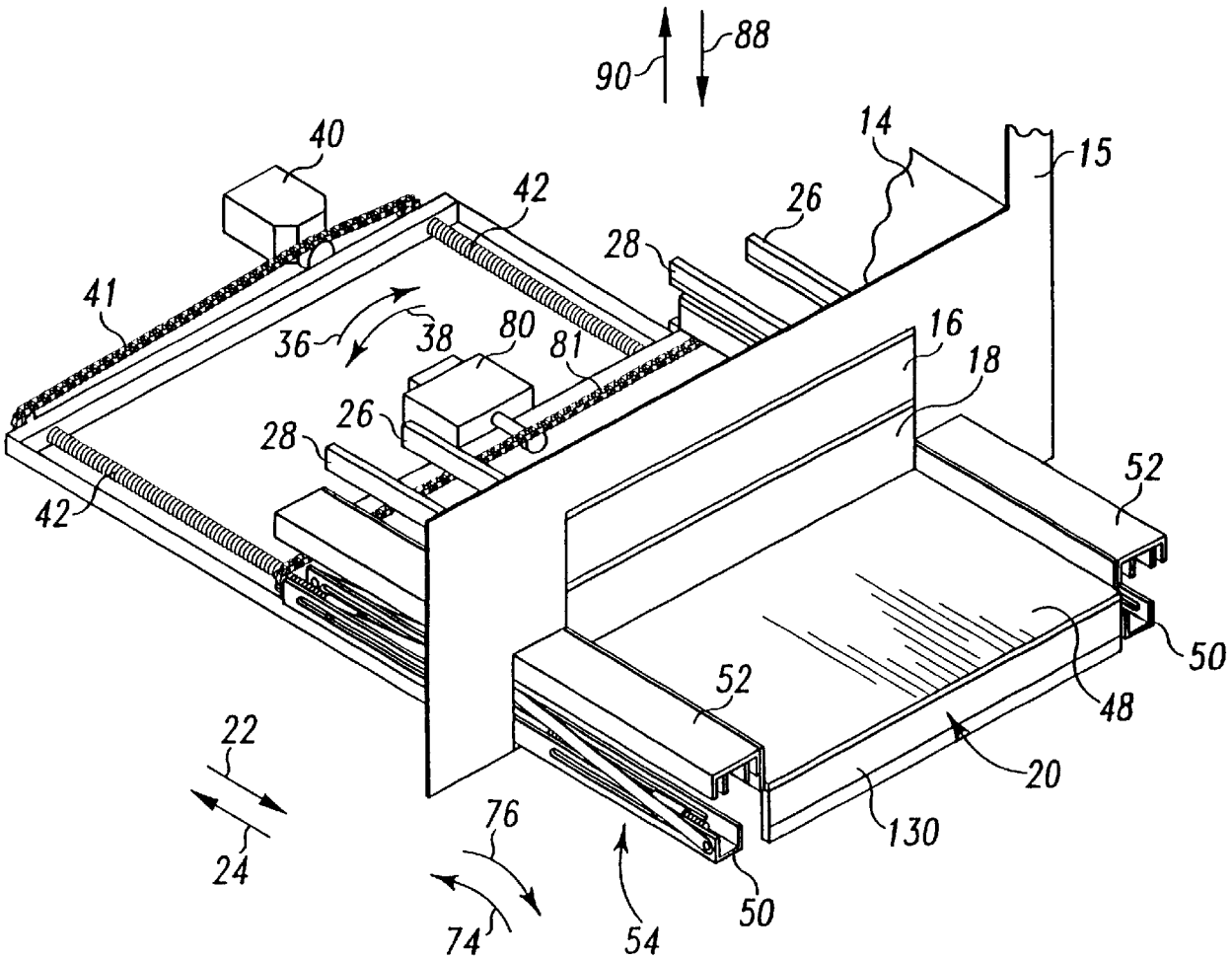
FIG. 2 is a perspective view of the convertible lift mechanism of FIG. 1 showing a first retractable stair and a second retractable stair in retracted position.

After the conversion stair 20 is vertically positioned between the lower surface 12 and the upper surface 14 in accordance with its function as a stair, the conversion stair 20 then horizontally moves to its partially retracted state as shown in FIG. 2. To move the conversion stair 20 to its partially retracted position, the positioning motor 40 is activated to cause the positioning shafts 42 to rotate in the general direction of arrow 38. As the positioning motor 40 rotates the positioning shafts 42 in the general direction of arrow 38, the positioning nuts 44 advance along the respective positioning shaft 42 in the general direction of arrow 24 so as to urge the conversion stair 20 in the general direction of arrow 24. Once the conversion stair 20 is in the partially retracted position, the positioning motor 40 stops.

Finally, to complete the conversion of the convertible lift mechanism 10 from the second configuration to the first configuration, the first retractable stair 16 and the second retractable stair 18 are moved into their extended position. To move the first retractable stair 16 and the second retractable stair 18 to the extended position, the retraction motor is activated in a second direction to cause the retraction linkage 32 to contract. As the retraction linkage 32 contracts, it urges the second retractable step 18 in the general direction of arrow 22. As the second retractable step 18 moves forward in the direction of arrow 22, the lip 18*a* engages the back of the riser of the first retractable step 16. The continued movement of the second retractable step 18 then causes similar movement of the first retractable step 16 in the direction of arrow 22. Once both the first retractable step 16 and the second retractable step 18 in the extended position shown in FIG. 1, the retraction motor stops.

Once the conversion stair 20 is positioned in its partially retracted position and the first retractable stair 16 and second retractable stair 18 are in the extended position, the convertible lift mechanism 20 is again in the first configuration. Accordingly, the convertible lift mechanism 20 is configured for use as a stairway.

It is noted that the convertible lift mechanism 10 in the second configuration can also be used to transport the personal vehicle from the upper surface 14 to the lower surface 12. To transport the personal vehicle from the upper surface 14 to the lower surface 12, the convertible lift mechanism 10 is converted from the first configuration to the second configuration as described above. In the second configuration, the convertible lift mechanism 10 then moves the surface 48 to the second position (at the upper surface 14), allows the personal vehicle to board, and then moves the surface the first position (at the lower surface 12).

Referring now to FIGS. 7–12, there is shown another embodiment of a convertible lift mechanism (hereinafter designated with reference numeral 300) which incorporates the features of the present invention therein. The convertible lift mechanism 300 is somewhat similar to the convertible lift mechanism 10. In particular, as shall be discussed below in greater detail, the convertible lift mechanism 300, similarly to the lift mechanism 10, includes a number of retractable stairs 302. However, unlike the convertible lift mechanism 10, the bottom step of the convertible lift mechanism 300 does not convert into a lift platform. Rather, the convertible lift mechanism 300 includes a lift platform 304 (see FIGS. 11 and 12) which is positioned under the retractable stairs 302. As shall be discussed below in greater detail, such a configuration provides the convertible lift mechanism 300 with numerous advantages.

Figure 7:
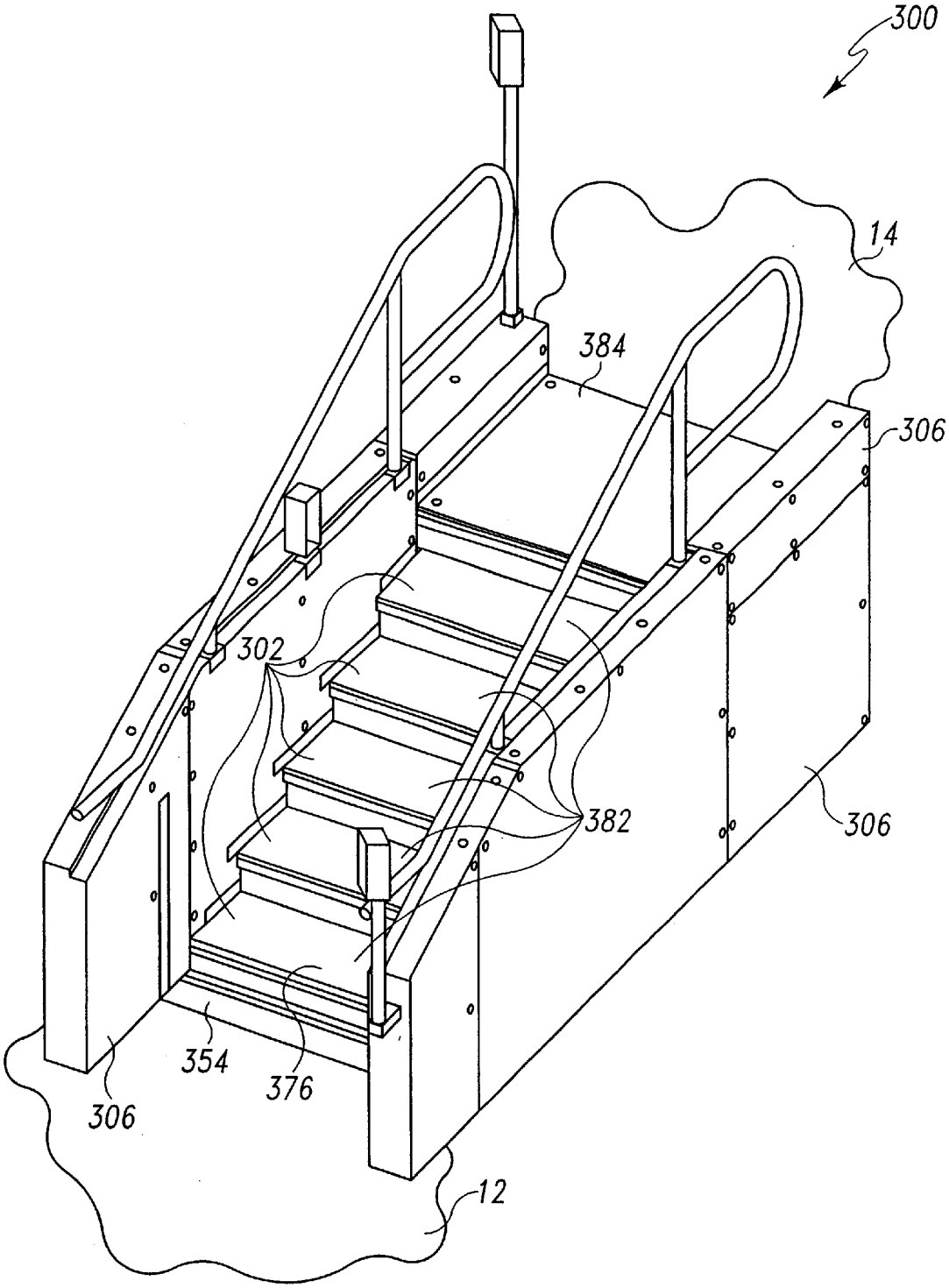
FIG. 7 is a perspective view of another embodiment of a convertible lift mechanism which incorporates the features of the present invention therein.

As shown in FIG. 7, the convertible lift mechanism 300 has a number of side panels 306 secured thereto. The side panels 306 function not only as a decorative addition to the lift mechanism 300, but also to protect and conceal the internal components associated therewith. The side panels 306 may be constructed of a number of different materials and colors to fit the motive of the area or building in which the convertible lift mechanism is installed.

As with the lift mechanism 10, the convertible lift mechanism 300 is provided to lift a person or an object, such as a wheelchair or other personal vehicle, from the lower surface 12 to the vertically displaced upper surface 14. In particular, as shall be discussed below in greater detail, the retractable stairs 302 may be retracted into a stair-receiving opening 308 defined in a vertical wall 310 (see FIG. 11) so as to expose the lift ramp 304. The person or object to be lifted may then be advanced onto the lift ramp 304 such that the lift ramp 304 may be utilized to lift the person or object from the lower surface 12 to the upper surface 14.

Figure 11:
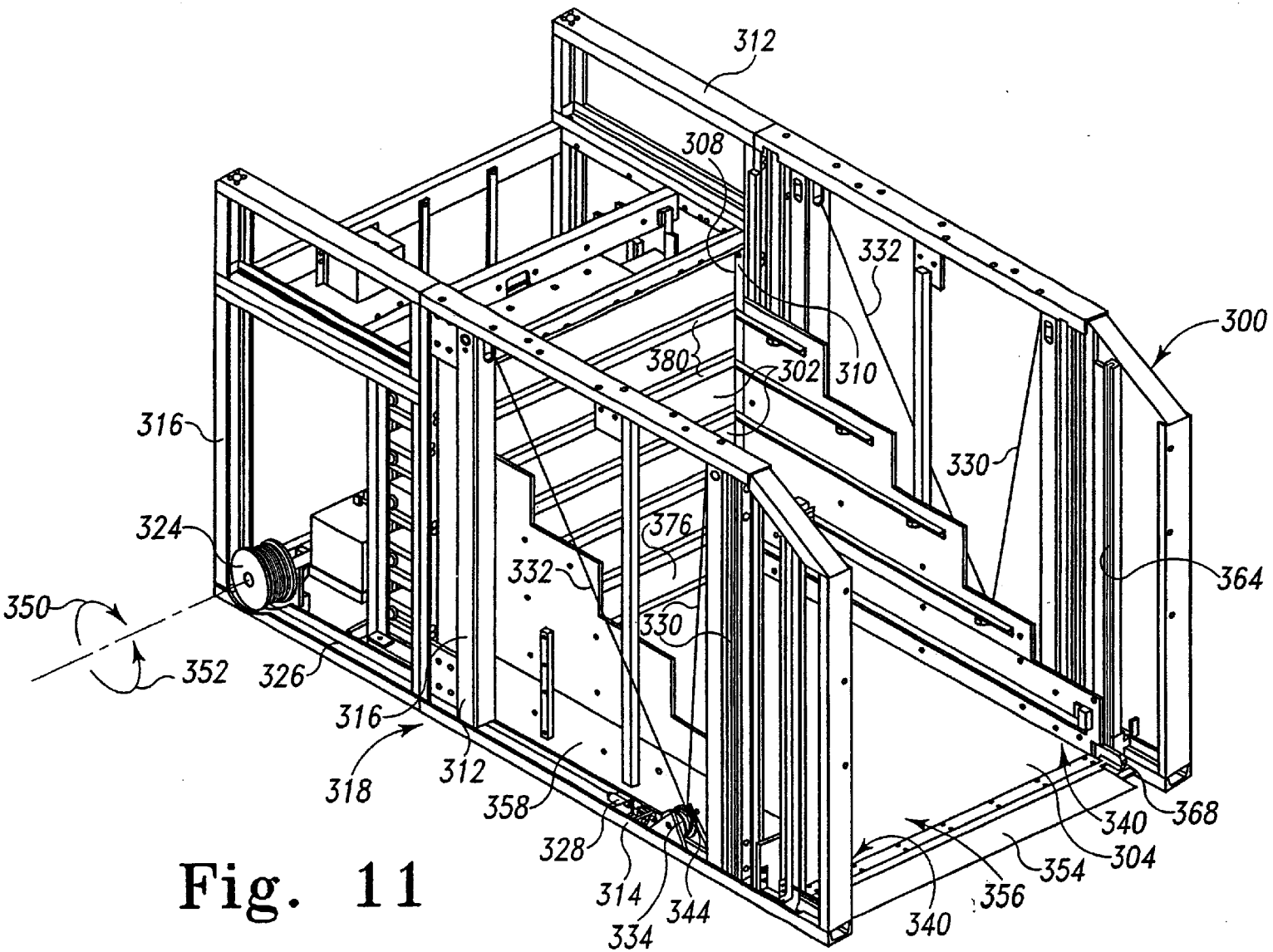
Figure 12:
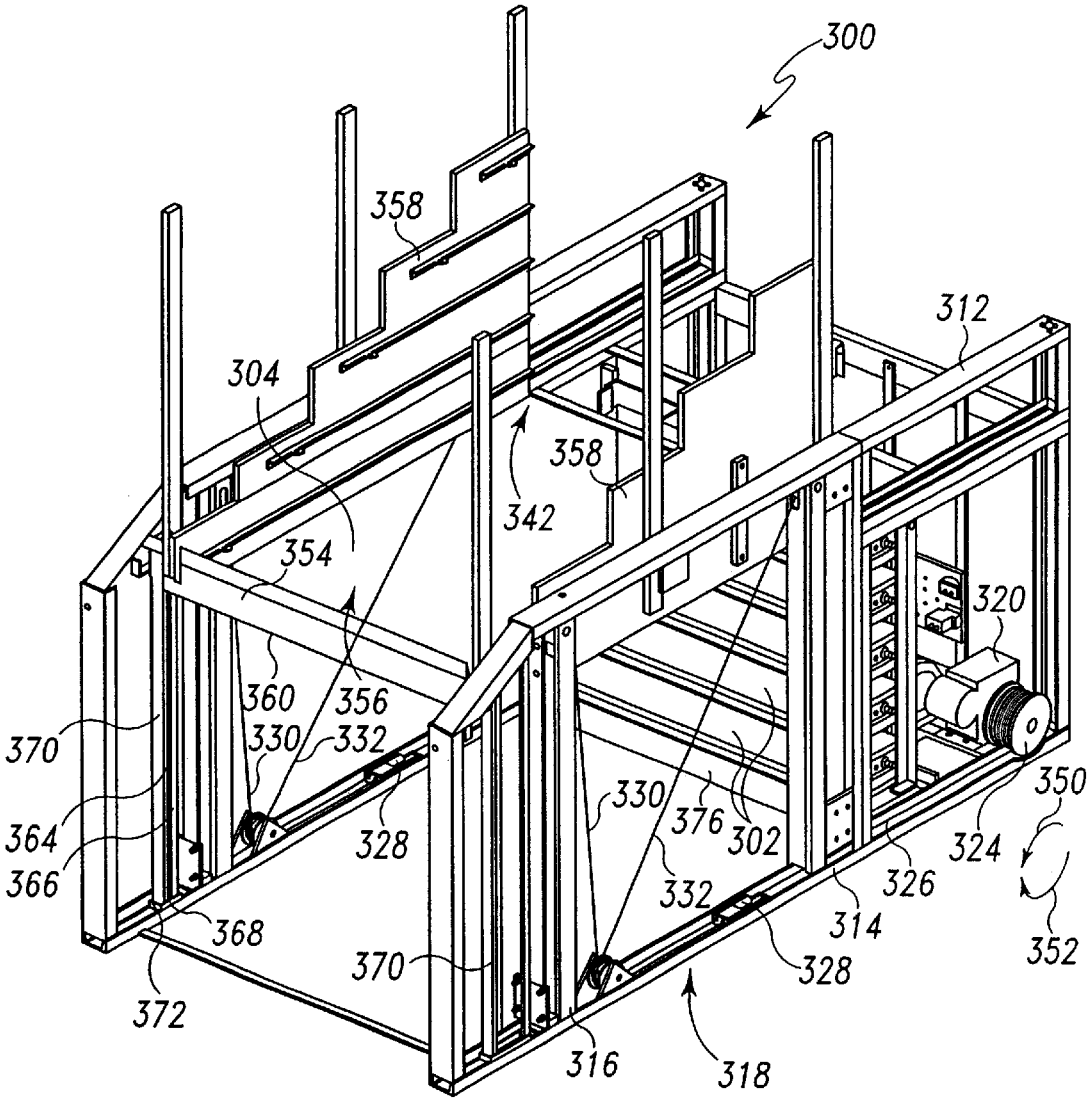
FIG. 12 is a view similar to FIG. 8, but showing the lift platform of the convertible lift mechanism positioned in its raised platform position.

The convertible lift mechanism 300 includes a frame 312 which provides the necessary structural rigidity for the lift mechanism 300. The frame 312 includes a number of horizontally disposed, U-shaped channels 314, along with a number of vertically disposed support beams 316. The frame 312 is also provided to support a cable and pulley lifting assembly 318 which is provided to, in lieu of the scissor linkages associated with the lift mechanism 10, move the lift platform 302 between its lowered platform position (as shown in FIGS. 7–11) and its raised platform position (as shown in FIG. 12). Specifically, one end of the lifting assembly 318 is mechanically coupled to the lift platform 304, whereas the other end of the lifting assembly is operatively coupled to a drive motor 320 (see FIG. 10). An output of the drive motor 320 is secured to a drive shaft 322 (see FIG. 10) which has a cable drum 324 on each end thereof. A first end of each of a number of cables 326 is wound around the respective cable drum 324 with a second end thereof being secured to a coupler 328.

The couplers 328 are slidably retained in the U-shaped channels 314 of the frame 312. Moreover, each of the couplers 328 has a first end of a pair of cables 330, 332 secured thereto. The cable 330 is advanced around a first lower frame pulley 334 and a first upper frame pulley 336 such that a second end thereof may be secured to a chain 338. The chain 338 is in turn secured to one of the forward corner portions 340 of the lift platform 304. In a similar manner, the cable 332 is advanced around a first lower frame pulley 344 and a first upper frame pulley 346 (see FIG. 9) such that a second end thereof may be secured to a chain (not shown). The chain to which the cable 332 is secured is in turn secured to one of the rear corner portions 342 of the lift platform 304.

Hence, when the drive motor is operated so as to rotate the drive shaft 322 in the general direction of arrow 350, the lift platform is raised upwardly. In particular, rotation of the drive shaft 322 in the general direction of arrow 350 causes the cables 326 to be wound around the cable drums 324 thereby pulling or otherwise urging the couplers 328 in a rearward direction (i.e. in the general direction toward the cable drums 324). This rearward movement of the couplers 328 pulls or otherwise exerts force on the cables 330, 332 which in turn causes the lift platform 304 to be lift upwardly from its lowered platform position to its raised platform position.

Such movement of the lift platform 304 from its lowered platform position to its raised platform position is utilized to lift the person or object from the lower surface 12 to the upper surface 14. In particular, as shown in FIGS. 7–11, when the lift platform 304 is positioned in its lowered platform position, the lift platform 304 is approximately level with the lower surface 12. However, when the lift platform 304 is positioned in its raised platform position, the lift platform 304 is approximately level with the upper surface 14. Accordingly, movement of the lift platform 304 from its lowered platform position to its raised platform position enables the object or person to be lifted from the lower surface 12 to the upper surface 14.

Conversely, when the drive motor is operated so as to rotate the drive shaft 322 in the general direction of arrow 352, the lift platform is lowered or otherwise moved downwardly. In particular, rotation of the drive shaft 322 in the general direction of arrow 352 causes the cables 326 to be unwound from around the cable drums 324 thereby allowing the couplers 328 to be urged in a forward direction (i.e. in a direction generally away from the cable drums 324) by the weight of the lift platform 304. This forward movement of the couplers 328 allows the lift platform 304 to be lowered downwardly from its raised platform position to its lowered platform position.

The lift platform 304 has a gate member 354 pivotally secured thereto. The gate member 354 functions as both a bridging surface for bridging the gap between the lift platform 304 and the lower surface 12 and a retaining surface for retaining the object or person on the lift platform 304 when the lift platform 304 is being moved or positioned in its raised platform position. In particular, the gate member 354 is positionable in either an extended gate position (as shown in FIGS. 7–11) in which the gate member 354 is orientated in an orientation that is substantially parallel to the upper surface of the lift platform 304 or a retracted gate position (as shown in FIG. 12) in which the gate member 354 is orientated in an orientation that is substantially perpendicular to the upper surface of the lift platform 304. It should be appreciated that when the gate member 354 is positioned in its extended gate position, an object such as a wheelchair may be rolled or otherwise advanced from the lower surface 12 to the upper surface of the lift platform 304 via the bridging surface created by the gate member 354.

Conversely, when the gate member 354 is positioned in its retracted gate position, such an object is retained on the upper surface of the lift platform 304 since the gate member 354 prevents the object from rolling off the front edge portion 356 of the lift platform 304. Note that a number of vertically arranged side panels 358 that are secured to the lift platform 304, along with the front faces of the retracted stairs 302, also help retain or otherwise prevent the object from rolling off of the lift platform 304 during raising or lowering thereof.

The gate member 354 is hinged to the lift platform 304 by an elongated hinge 360. Moreover, the gate member 354 has a pin 362 on each side thereof which is captured in a slot 364 defined in a pair of vertical support members 370 (see FIG. 12). The slot 364 has a substantially vertical portion 366 and a substantially horizontal portion 368, with a rounded cam surface 372 therebetween. Movement of the pins 362 within the slot 364 causes movement of the gate member 354 between its extended gate position and its retracted gate position. In particular, when the pins 362 are positioned in the horizontal portion 368 of the slot 364, the gate member 354 is allowed to pivot about the hinge 360 so as to assume its extended gate position as shown in FIGS. 7–11. However, as the lift platform 304 begins to be raised by the cable and pulley system 31 8, the pins 362 are advanced around the rounded cam surface 372 thereby causing the hinge 360 and hence the gate member 354 to pivot upwardly so as to move the gate member from its extended gate position to its retracted gate position. Moreover, once pivoted into is retracted gate position, the walls of the vertical portions 366 of the slots 364 retain the pins 362 thereby preventing the gate member 354 from pivoting back into its extended gate position. In such a way, the gate member 354 is held firmly in its retracted gate position until the lift platform 304 is lowered back to its lowered platform position at which time the pins 362 are advanced back around the rounded cam surface 372 and into the horizontal portions 368 of the slots 364 thereby causing the hinge 360 and hence the gate member 354 to pivot back into its extended gate position.

Hence, as described herein, the gate member 354 functions similarly as the convertible riser 130 of the convertible lift mechanism 10. In particular, as described above in reference to the convertible lift mechanism 10, when the conversion stair 20 is in the second configuration and the horizontal lifting surface 48 is approximately level with the lower surface 12, the convertible riser 130 is positioned in a second mode of operation shown in FIGS. 4 and 6B. In the second mode of operation, the convertible riser 130 extends substantially horizontally outward so as to function as a ramp between the lower surface 12 and the horizontal lifting surface 48 thereby allowing a wheelchair or other personal vehicle to move between the first surface 12 to the horizontal lifting surface 48. Conversely, the convertible riser 130 may also be operated in its third mode of operation as shown in FIGS. 5, 5A and 6C. In the third mode of operation, the convertible riser 130 is oriented substantially vertically in the general direction of arrow 90 from the surface horizontal lifting surface 48 thereby functioning as a safety guard to prevent a personal vehicle from accidentally moving in the general direction of arrow 22 beyond the edge of the horizontal lifting surface 48. As such, the convertible riser 130 is positioned in its third mode of operation at any time the conversion stair 20 is being used to move a personal vehicle between the first position to the second position.

It should be appreciated that although the gate member 354 is herein described as being secured to the lift platform 304 by use of the hinge 360, and has significant advantages thereby in the present invention, certain of such advantages may be obtained by use of other configurations. For example, the gate member 354 may be pinned on each side thereof to a block or other component that is movable with the lift platform 304. In such a configuration, the gate member 354 would not be secured directly to the lift platform 304, but rather would be secured to the lift platform via a number of intermediate components. Accordingly, as used herein in regard to the relationship between the lift platform 304 and the gate member 354, the term "pivotally secured" is intended to mean securement of the gate member 354 to the lift platform 304 in a pivoting manner in either a direct or indirect mechanical arrangement.

As alluded to above, in order to allow for movement of the lift platform 304 between its raised and lowered platform positions, the retractable stairs 302 are retracted into a stairs-receiving opening 308 defined in the vertical wall 310. In order to move each of the retractable stairs 302 in such a manner, the convertible lift mechanism 300 includes a source of motive power such as a drive sprocket and chain assembly 374 (see FIG. 10). The drive sprocket and chain assembly 374 includes a drive sprocket (not shown) and a chain (not shown) which are utilized to move a bottom stair 376 of the retractable stairs 302. In particular, the chain is preferably embodied as a rigid plastic chain that "bends" in only a single direction. More specifically, the chain bends in a direction which allows the chain to be wound or otherwise collected around the drive sprocket, but prevents the chain from bending in any other direction. In other words, when not wound around the drive sprocket, the chain forms a relatively taught, rigid structure that may be utilized to both push and pull the bottom stair 376 of the number of retractable stairs 302.

One way to construct such "one directional" bending chain is to modify plastic chain known as "wire track" chain which is utilized in moving components or machines to protect wires and the like. The wire track chain is preferably modified to include a guide pin (not shown) which is advanced through a slot defined in a guide block (not shown) which is configured to run parallel to the path of movement of the drive chain. Such use of a guide block not only prevents the chain from binding during movement thereof, but also helps retain the chain in a relatively rigid manner as it is utilized to push the bottom stair 376 of the retractable stairs 302.

Figure 10:
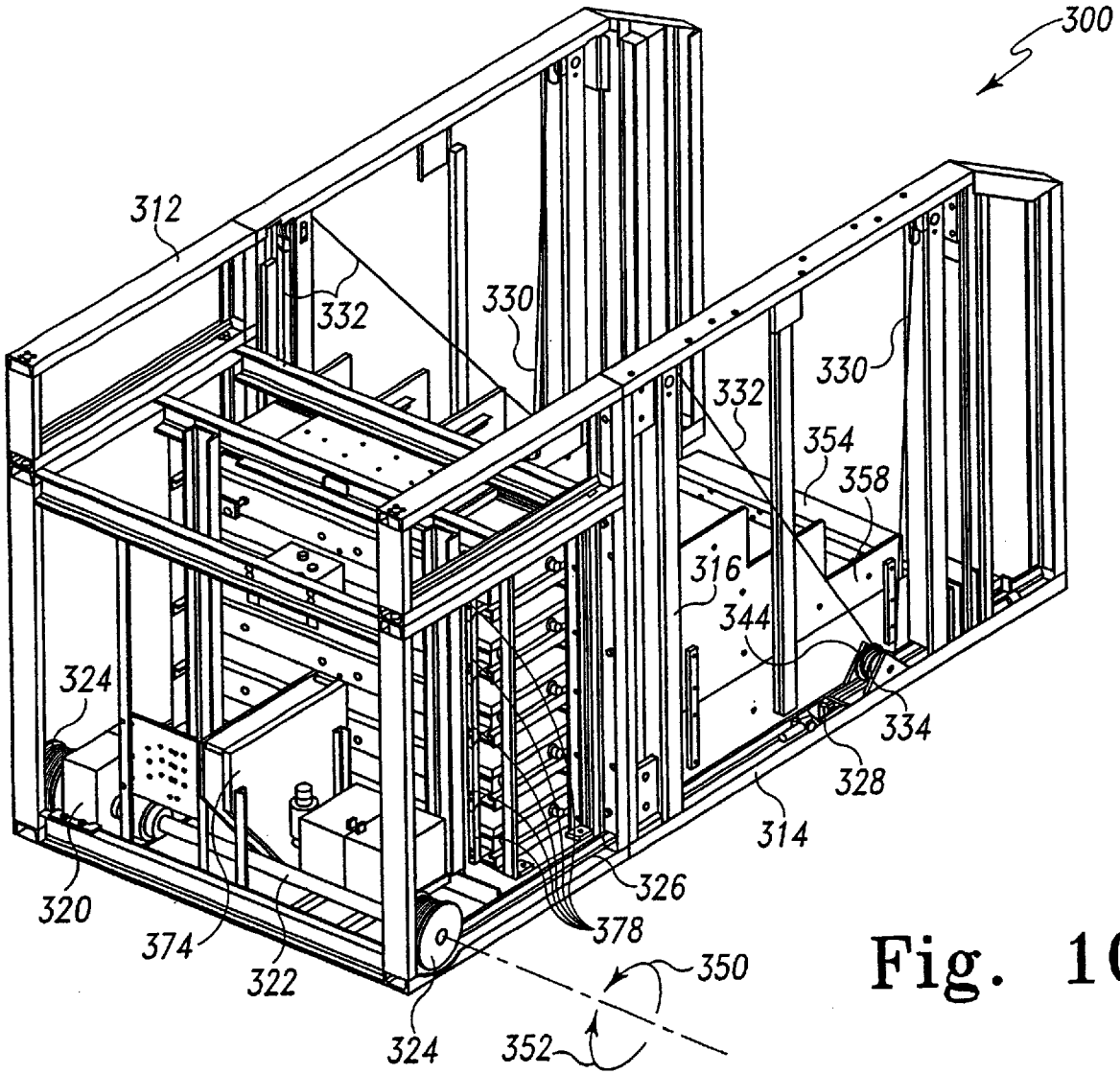
FIGS. 10 and 11 are rear perspective views of the convertible lift mechanism of FIG. 8, note that the retractable stairs are each shown in their respective retracted stair positions.

Each of the remaining retractable stairs 302 are mechanically linked to the bottom stair 376 by a number of flanges 378 (see FIG. 10). In particular, as the bottom stair 376 is being extended or otherwise urged outwardly by the drive sprocket and chain assembly 374, the flange 378 contacts a downwardly extending flange 380 (see FIG. 11) secured to the front of the retractable stair 302 positioned directly above it so as to pull the stair 302 outwardly. Similarly, the flange 378 of the pulled second stair 302 then contacts the downwardly extending flange 380 of the retractable stair 302 positioned directly above it so as to pull it out. Such pulling of the stairs 302 is repeated until all of the retractable stairs 302 have been pulled outwardly into their respective extended stair positions.

The flanges 378 are also utilized to retract each of the retractable stairs 302 into their respective retracted stair positions in which the stairs 302 are received back into the stair-receiving opening 308 defined in the vertical wall 310. In particular, as the drive sprocket and chain assembly 374 pulls the bottom stair 376 rearwardly (i.e. in the general direction toward the drive motor 320 or the cable drums 324), the top portion of the flange 378 of the bottom stair 376 engages the bottom portion of the flange 378 secured to the stair 302 directly thereabove (see FIG. 10). Such engagement of the adjacent flanges 378 is continued until all of the stairs 302 have been retracted back into their respective retracted stairs positions, as shown in FIG. 10.

Figure 8:
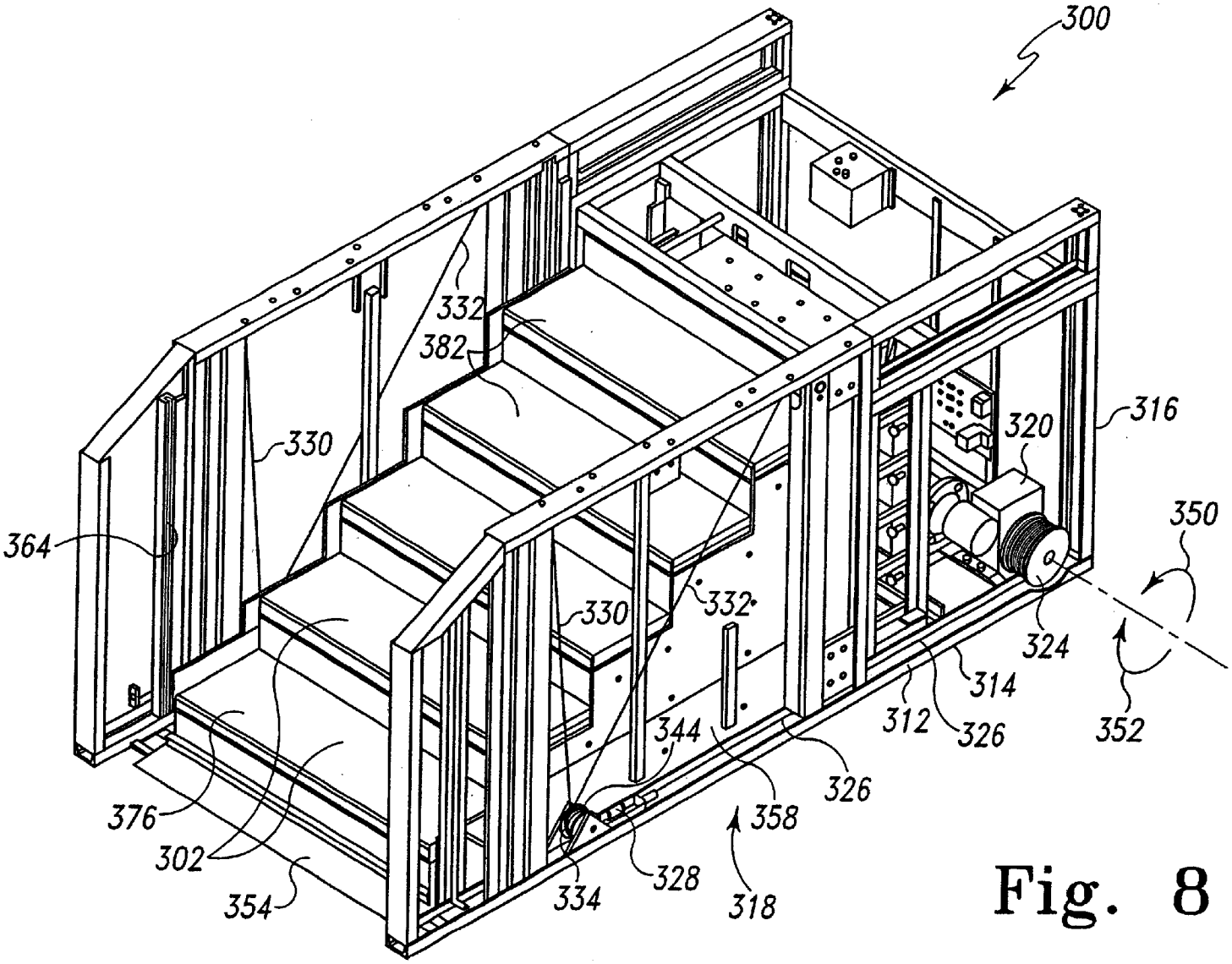
FIG. 8 is a view similar to FIG. 7, but showing the side panels of the convertible lift mechanism removed for clarity of description.
Figure 9:
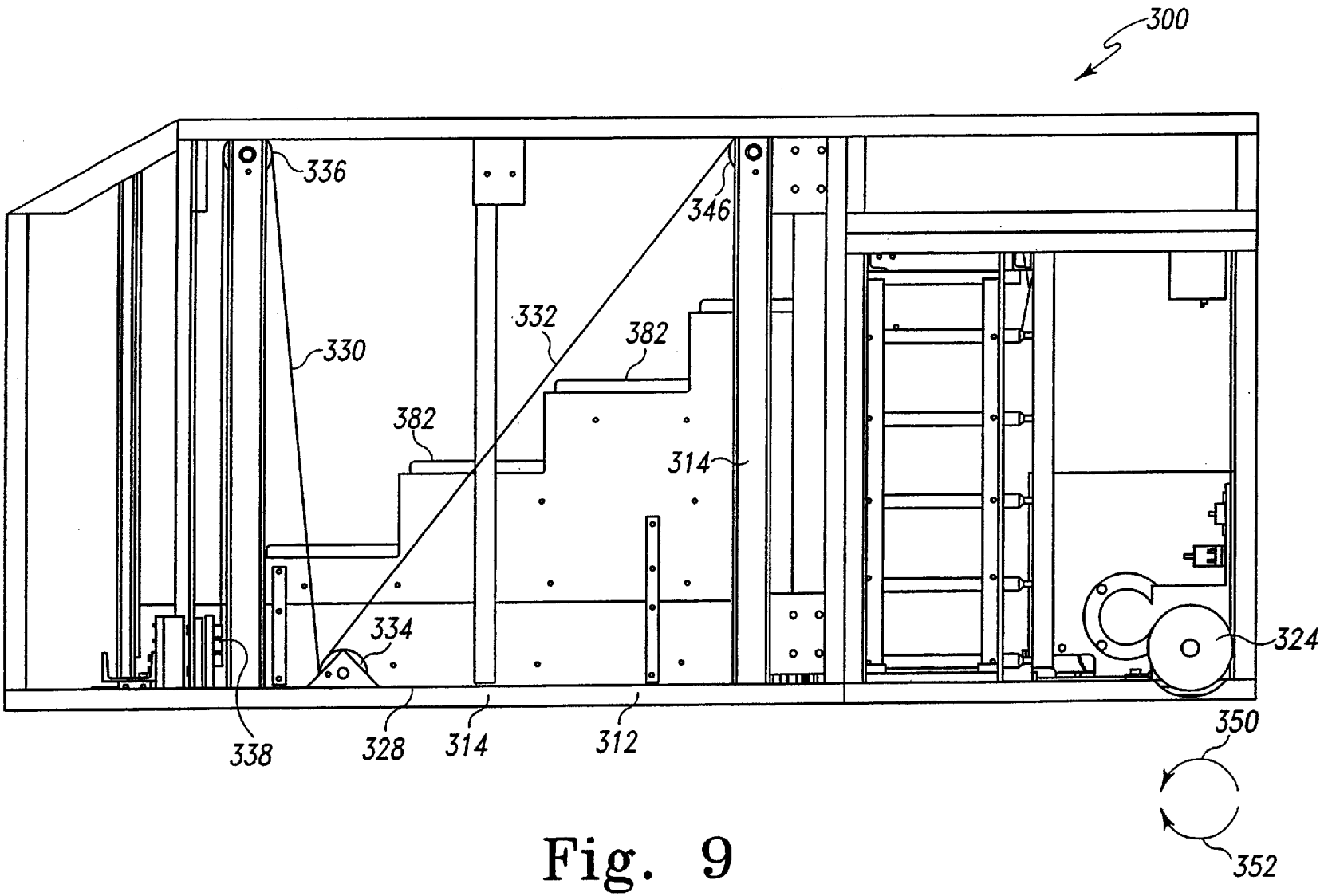
FIG. 9 is a side elevational view of the convertible lift mechanism of FIG. 8.

As shown in FIGS. 7 and 8, each of the retractable stairs 302 has a substantially horizontal stepping surface 382 associated therewith. As its name implies, the stepping surface 382 is the portion of the stair 302 on which a user would step if the user were walking up or down the stairs 302. Accordingly, the stepping surface 382 of a given retractable stair 302 is retracted or otherwise received into the stair-receiving opening 308 defined in the vertical wall 310 when the retractable stair 302 is positioned in its retracted stair position, as shown in FIGS. 10–12. Conversely, the stepping surface 382 of a given retractable stair 302 extends out of the stair-receiving opening 308 defined in the vertical wall 310 when the retractable stair 302 is positioned in its extended stair position, as shown in FIGS. 7–9. As such, a user is able to walk up or down the retractable stairs 302 when the stairs 302 are positioned in their respective extended stair positions, but would be unable to walk up or down the stairs 302 when the stairs 302 are positioned in their respective retracted stair positions.

In operation, the convertible lift mechanism 300 may be utilized to move an object or person, such as a wheelchair or other personal vehicle, between the lower surface 12 and the vertically displaced upper surface 14. In particular, in order to convert the lift mechanism 300 from a configuration in which a person can walk up or down the stairs 302 to a configuration in which the lift platform 304 of the lift mechanism 300 may be utilized, the following sequence occurs.

Firstly, the retractable stairs 302 are retracted from their extended stair positions to their retracted stair positions. In particular, the drive sprocket and chain assembly 374 is actuated so as to pull or otherwise urge the bottom stair 376 rearwardly (i.e. in the general direction toward the drive motor 320 or the cable drums 324). During such rearward movement of the bottom stair 376, the top portion of the flange 378 of the bottom stair 376 engages the bottom portion of the flange 378 secured to the stair 302 directly thereabove (see FIG. 10), which in turn engages the flange 378 of the stair positioned thereabove, and so on. Such engagement of the adjacent flanges 378 is continued until all of the stairs 302 have been retracted back into their respective retracted stairs positions, as shown in FIG. 10, at which time the drive sprocket and chain assembly 374 is deactuated.

Once each of the stairs 302 has been retracted into their respective retracted stair positions, the object or person may be advanced onto the upper surface of the lift platform 304. In the particular case of a personal vehicle such as a wheelchair, the vehicle may be advanced from the lower surface 12 to the upper surface of the platform lift 304 by rolling the vehicle across the bridging surface provided by the gate member 354 since the gate member 354 is positioned in its extended gate position (as shown in FIG. 11). Once the object or person has been advanced onto the lift platform 304, the lift platform 304 may be raised.

In particular, the drive motor 320 is operated so as to rotate the drive shaft 322 in the general direction of arrow 350. Such rotation of the drive shaft 322 in the general direction of arrow 350 causes the cables 326 to be wound around the cable drums 324 thereby pulling or otherwise urging the couplers 328 in a general rearward direction (i.e. in a direction toward the cable drums 324). This rearward movement of the couplers 328 pulls or otherwise exerts force on the cables 330, 332 which in turn causes the lift platform 304 to be lifted upwardly from its lowered platform position to its raised platform position in which the lift platform 304 is positioned approximately level with the upper surface 14.

During such upward movement of the lift platform 304, the gate member 354 is positioned in its retracted gate position in order to prevent the personal vehicle from inadvertently rolling off of the front edge portion 356 of the lift platform 304. In particular, as the lift platform 304 moves upwardly, the pins 362 extending outwardly from the gate member 354 are advanced through the slot 364. More specifically, the pins 362 are initially advanced around the rounded cam surface 372 of the slot 364 thereby causing the hinge 360 and hence the gate member 354 to pivot upwardly so as to move the gate member from its extended gate position to its retracted gate position. Once pivoted into is retracted gate position, the walls of the vertical portions 366 of the slots 364 retain the pins 362 thereby preventing the gate member 354 from pivoting back into its extended position during movement of the lift platform 304 or while the platform 304 is positioned in its raised platform position.

Once the lift platform 304 comes to rest at its raised platform position, the object or person may be advanced off of the upper surface of the lift platform 304 and onto the upper surface 14. In the particular case of a wheelchair or other personal vehicle, the vehicle may be rolled off of the lift platform 304, across an upper platform 384, and onto the upper surface 14.

In order to return the convertible lift mechanism 300 to its original configuration, the lift platform 304 is first lowered back into its lowered platform position. In particular, the drive motor is operated so as to rotate the drive shaft 322 in the general direction of arrow 352. Such rotation of the drive shaft 322 in the general direction of arrow 352 causes the cables 326 to be unwound from around the cable drums 324 thereby allowing the couplers 328 to be urged in a generally forward direction (i.e. in a direction away from the cable drums 324) by the weight of the lift platform 304. This forward movement of the couplers 328 allows the lift platform 304 to be lowered downwardly from its raised platform position to its lowered platform position.

Near or at the end of such downward movement of the lift platform 304, the gate member 354 is returned to its extended gate position. In particular, as the lift platform 304 is lowered back to its lowered platform position, the pins 362 extending outwardly from the gate member 354 are downwardly advanced through the vertical portion 366 of the slots 364, around the rounded cam surface 372, and into the horizontal portions 368 of the slots 364 thereby causing the hinge 360 and hence the gate member 354 to pivot back into its extended gate position.

Thereafter, each of the retractable stairs 302 is advanced back into its extended stair position. In particular, the drive sprocket and chain assembly 374 is actuated so as to urge the bottom stair 376 in a forward direction (i.e. in the general direction away from the drive motor 320 or the cable drums 324). As the bottom stair 376 is extended or otherwise urged outwardly in such a manner, the flange 378 associated with the bottom stair 376 contacts a downwardly extending flange 380 (see FIG. 11) secured to the front of the retractable stair 302 positioned directly above it so as to pull the stair 302 outwardly. Similarly, the flange 378 of the pulled second stair 302 then contacts the downwardly extending flange 380 of the retractable stair 302 positioned directly above it so as to pull it outwardly. Such pulling of the stairs 302 is repeated until all of the retractable stairs 302 have been pulled outwardly into their respective extended stair positions thereby returning the convertible lift mechanism 300 to its original configuration.

Figure 13:
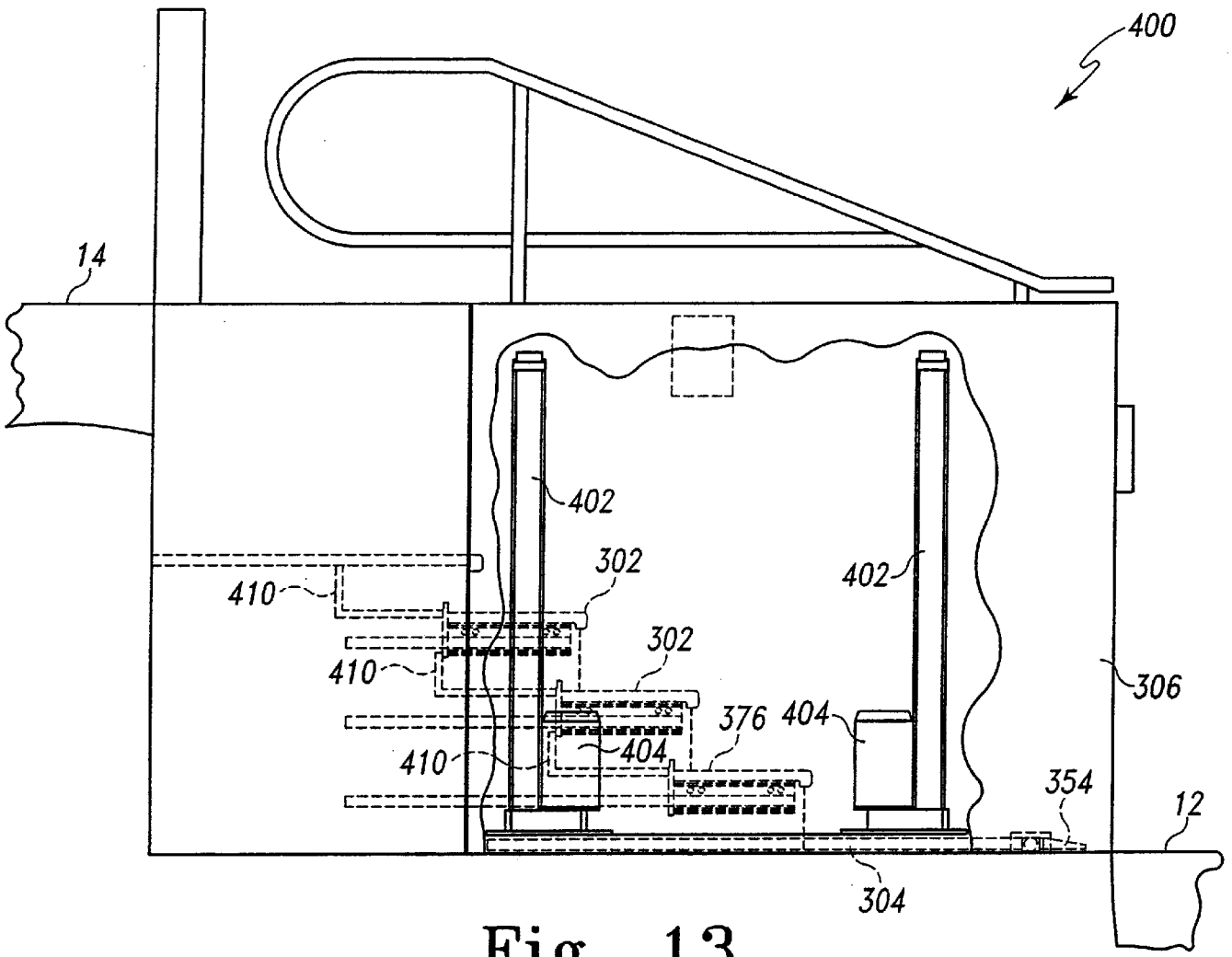
FIG. 13 is a cutaway side elevational view of yet another embodiment of a convertible lift mechanism which incorporates the features of the present invention therein.
Figure 14:
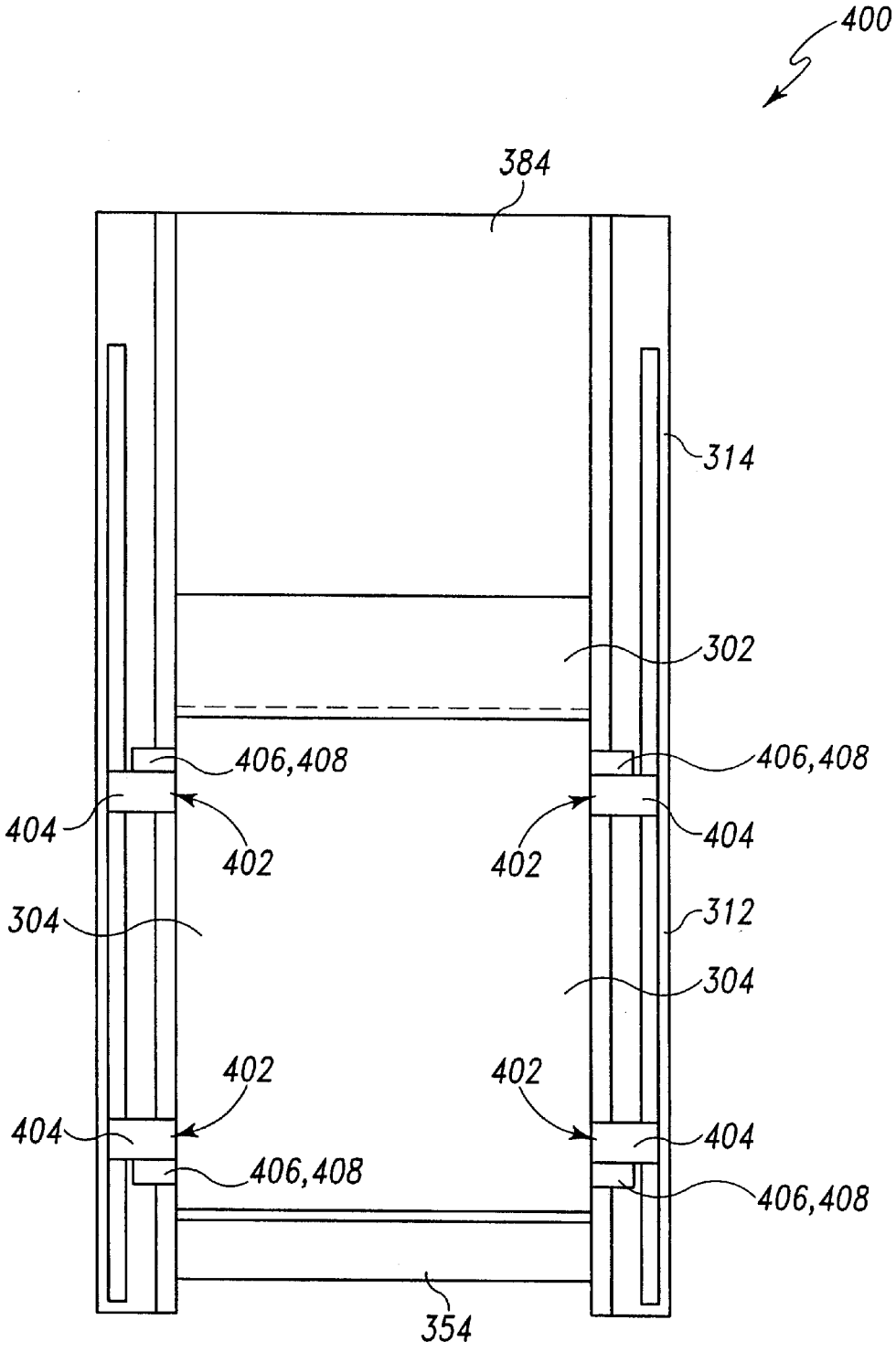
FIG. 14 is a plan view of the convertible lift mechanism of FIG. 13.
Figure 15:
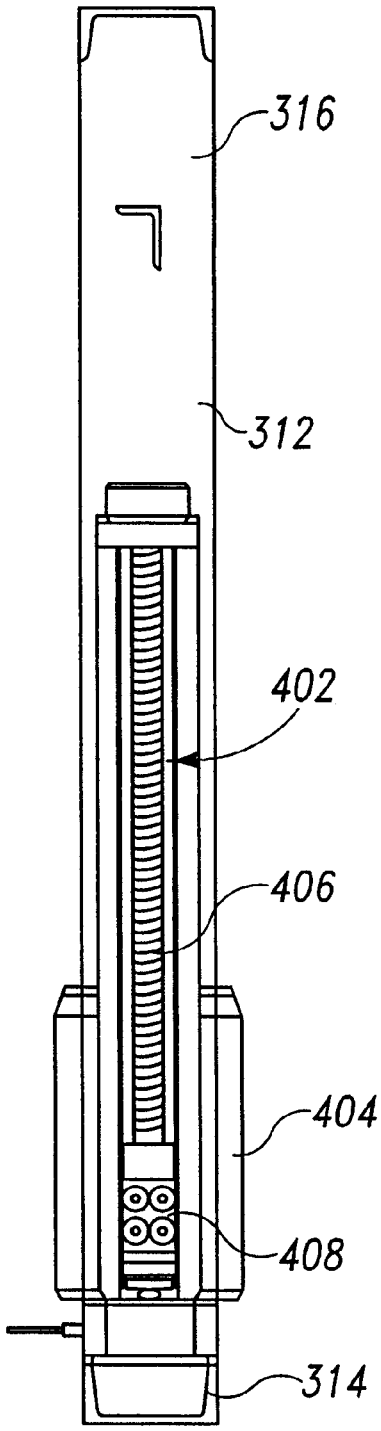
FIG. 15 is side elevational view which shows the column screw mechanism of the convertible lift mechanism of FIG. 13 secured to the frame.

Referring now to FIGS. 13–15, there is shown another embodiment of a convertible lift mechanism (hereinafter referred to with reference numeral 400) which incorporates the features of the present invention therein. The convertible lift mechanism 400 is somewhat similar to the convertible lift mechanism 300. Accordingly, the convertible lift mechanism 400 includes a number of components which are identical to certain of the components previously discussed in regard to the convertible lift mechanism 300. The same reference numerals are utilized in FIGS. 13–15 to designate identical components which were previously discussed in regard to FIGS. 7–12 and additional discussion thereof is not warranted.

The convertible lift mechanism 400 is essentially the same as the convertible lift mechanism 300 except that the convertible lift mechanism 400 utilizes different components to perform the functions of (i) raising and lowering the lift platform 304, and (ii) extending and retracting the retractable stairs 302. In particular, as shall be discussed below in greater detail, the convertible lift mechanism 400 utilizes a number of vertical screw drive mechanisms to raise and lower the rectangular-shaped lift platform 304, whereas a number of linear actuators are utilized to extend and retract each of the retractable stairs 302.

As alluded to above, the convertible lift mechanism 400 includes a number of vertical screw lift mechanisms 402. Each of the vertical screw lift mechanisms 402 is preferably embodied as a column screw mechanism and, as such, includes a drive motor 404 having an output which drives a vertically arranged threaded shaft 406 (see FIG. 15). A threaded lift nut 408 translates upwardly and downwardly along the threaded shaft 406 based on the direction of rotation of the shaft 406. In particular, when the drive motor 404 drives the threaded shaft 406 in a first direction, the lift nut 408 is driven in an upward direction, whereas when the drive motor 404 is reversed so as to drive the threaded shaft in the opposite direction, the lift nut 408 is driven in a downward direction.

In one exemplary embodiment, the convertible lift mechanism 400 is configured to include four column screw mechanisms 402. As shown in FIG. 14, a column screw mechanism 402 is provided to lift each corner portion of the rectangular-shaped lift platform 304. Specifically, the lift nut 408 associated with each of the column screw mechanisms 402 is secured to a respective corner portion of the lift platform 304. In such a configuration, upward and downward movement of the lift nuts 408 causes similar upward and downward movement of the lift platform 304. In particular, when the drive motors 404 are operated so as to drive the lift nuts 408 upwardly, the lift platform 304 is likewise driven upwardly. Conversely, when the drive motors 404 are operated so as to drive the lift nuts 408 downwardly, the lift platform 304 is likewise driven downwardly.

Use of the column screw mechanisms 402 provides a number of advantages to the convertible lift mechanism 400. For example, use of the column screw mechanisms 402 facilitates ease of assembly of the convertible lift mechanism 400. In particular, as shown in FIG. 15, the configuration of the column screw mechanisms 402 allows for securement of the mechanism 402 to only the lower portion of the frame 312. Indeed, only the lower portion of the column screw mechanisms 402 is secured to the frame 312, with the upper portion of the column screw mechanisms 402 being allowed to "float" relative to the frame 312. In such a configuration, structural rigidity for the upper portion of the column screw mechanisms 402 is provided by the lift platform 304 as it is raised upwardly. It should be appreciated, however, that if a particular design of the convertible lift mechanism 400 so required, the upper portions of the column screw mechanisms 402 could be bolted or otherwise secured to the frame 312.

Although the column screw mechanisms 402 are described herein as each including a dedicated drive motor 404, and has significant advantages thereby in the present invention, it should be appreciated that other configurations are also contemplated. For example, a mechanical transmission assembly (not shown) could be utilized to drive each of the threaded shafts of the individual screw mechanisms from a single drive motor.

The convertible lift mechanism 400 also includes a source of motive power such as a number of linear actuators 410. The linear actuators 410 are provided, in lieu of the drive sprocket and chain assembly 374, to move the retractable stairs 302 between their respective extended and retracted stair positions. In particular, a first end of each of the linear actuators 410 is secured to a flange (not shown) associated with the stair 302 positioned immediately above the stair 302 to be moved by the actuator 410. The other end of the linear actuator 410 is secured to the stair 302 which is to be moved. It should be appreciated that in the case of the top stair 302, the first end of the linear actuator 410 associated therewith is secured to a flange (not shown) that is secured to the frame 412. This is done since, obviously, there is not a stair positioned above the top stair 302.

Actuation of the linear actuators 410 causes movement of the retractable stairs 302 relative to one another and hence the frame 312. In particular, extension of the linear actuators 410 associated with the top stair 302 causes the stairs 302 to be extended or otherwise moved in the forward direction (i.e. in the general direction toward the gate member 354) so as to position the stairs 302 in their respective extended stair positions. Conversely, retraction of each of the linear actuators 410 causes each of the stairs 302 to be retracted or otherwise moved in the rearward direction (i.e. in the general direction away from the member 354) so as to position the retractable stairs 302 in their respective retracted stair positions.

Such use of the linear actuators 410 provides the convertible lift mechanism 400 with numerous advantages. For example, by securing the first end of the linear actuators 410 to the stair positioned adjacent thereto (as opposed to, for example, securing each of the actuators 410 to the frame 312), each of the actuators 410 has the same stroke length. Hence, identical actuators 410 may be utilized for each stair 302 thereby reducing the number of different component types that are utilized in the construction of the lift mechanism 400.

As shown in FIG. 13, the convertible lift mechanism 400 also includes a gate member 354 which is identical in configuration and function to the gate member of the same reference numeral described above in regard to the convertible lift mechanism 300. Hence, the position of the gate member 354 is likewise controlled by movement of the lift platform 304 during operation of the lift mechanism 400. Accordingly, additional discussion of the structure and function of the gate member 354, as it pertains to the lift mechanism 400, is not warranted.

In operation, as with the other embodiments described above, the convertible lift mechanism 400 may be utilized to move an object or person, such as a wheelchair or other personal vehicle, between the lower surface 12 to the vertically displaced upper surface 14. In particular, in order to convert the mechanism lift 400 from a configuration in which a person can walk up or down the stairs 302 to a configuration in which the lift platform 304 of the lift mechanism 400 may be utilized, the following sequence occurs.

Firstly, the retractable stairs 302 are retracted from their extended stair positions to their retracted stair positions. In particular, the linear actuators 410 are actuated so as to pull or otherwise urge the retractable stairs 302 rearwardly (i.e. in the general direction away from the gate member 354) thereby positioning the retractable stairs 302 into their respective retracted stairs positions, as shown in FIG. 14.

Once each of the stairs 302 has been retracted into their respective retracted stair positions, the object or person may be advanced onto the upper surface of the lift platform 304. In the particular case of a personal vehicle such as a wheelchair, the vehicle may be advanced from the lower surface 12 to the upper surface of the platform lift 304 by rolling the vehicle across the bridging surface provided by the gate member 354 as the gate member 354 is positioned in its extended gate position (as shown in FIG. 13). Once the object or person has been advanced onto the lift platform 304, the lift platform 304 may be raised.

In particular, the drive motors 404 associated with the column screw mechanisms 402 are operated so as to rotate the threaded drive shafts 406 in the direction necessary to cause the lift nuts 408 to be moved upwardly along the shafts 406. Such upward movement of the lift nuts 408 causes the lift platform 304 to be lifted upwardly from its lowered platform position to its raised platform position in which the lift platform 304 is positioned approximately level with the upper surface 14.

During such upward movement of the lift platform 304, the gate member 354 is positioned in its retracted gate position in order to prevent the personal vehicle from inadvertently rolling off of the front edge portion 356 of the lift platform 304. In particular, as the lift platform 304 moves upwardly, the pins 362 extending outwardly from the gate member 354 are advanced through the slot 364. More specifically, the pins 362 are initially advanced around the rounded cam surface 372 of the slot 364 thereby causing the hinge 360 and hence the gate member 354 to pivot upwardly so as to move the gate member from its extended gate position to its retracted gate position. Once pivoted into is retracted gate position, the vertical portions 366 of the slots 364 retain the pins 362 thereby preventing the gate member 354 from pivoting back into its extended position during movement of the lift platform 304 or while the platform 304 is positioned in its raised platform position.

Once the lift platform 304 comes to rest at its raised platform position, the object or person may be advanced off of the upper surface of the lift platform 304 and onto the upper surface 14. In the particular case of a wheelchair or other personal vehicle, the vehicle may be roller off of the lift platform 304, across the upper platform 384, and onto the upper surface 14.

In order to return the convertible lift mechanism 400 to its original configuration, the lift platform 304 is first lowered back into its lowered platform position. In particular, the drive motors 404 associated with the column screw mechanisms 402 are operated so as to rotate the threaded drive shafts 406 in the opposite direction so as to cause the lift nuts 408 to be moved downwardly along the shafts 406. Such downward movement of the lift nuts 408 causes the lift platform 304 to be lowered downwardly from its raised platform position to its lowered platform position in which the lift platform 304 is positioned approximately level with the lower surface 12.

Near or at the end of such downward movement of the lift platform 304, the gate member 354 is returned to its extended gate position. In particular, as the lift platform 304 is lowered back to its lowered platform position, the pins 362 extending outwardly from the gate member 354 are downwardly through the vertical portion 366 of the slots 364, around the rounded cam surface 372, and into the horizontal portions 368 of the slots 364 thereby causing the hinge 360 and hence the gate member 354 to pivot back into its extended gate position.

Thereafter, each of the retractable stairs 302 is advanced back into its extended stair position. In particular, the linear actuators 410 are extended or otherwise actuated so as to push the retractable stairs 302 in a forward direction (i.e. in the general direction toward the gate member 354) thereby positioning the retractable stairs 302 into their respective extended stair positions, as shown in FIG. 13 which returns the convertible lift mechanism 400 to its original configuration.

Figure 16:
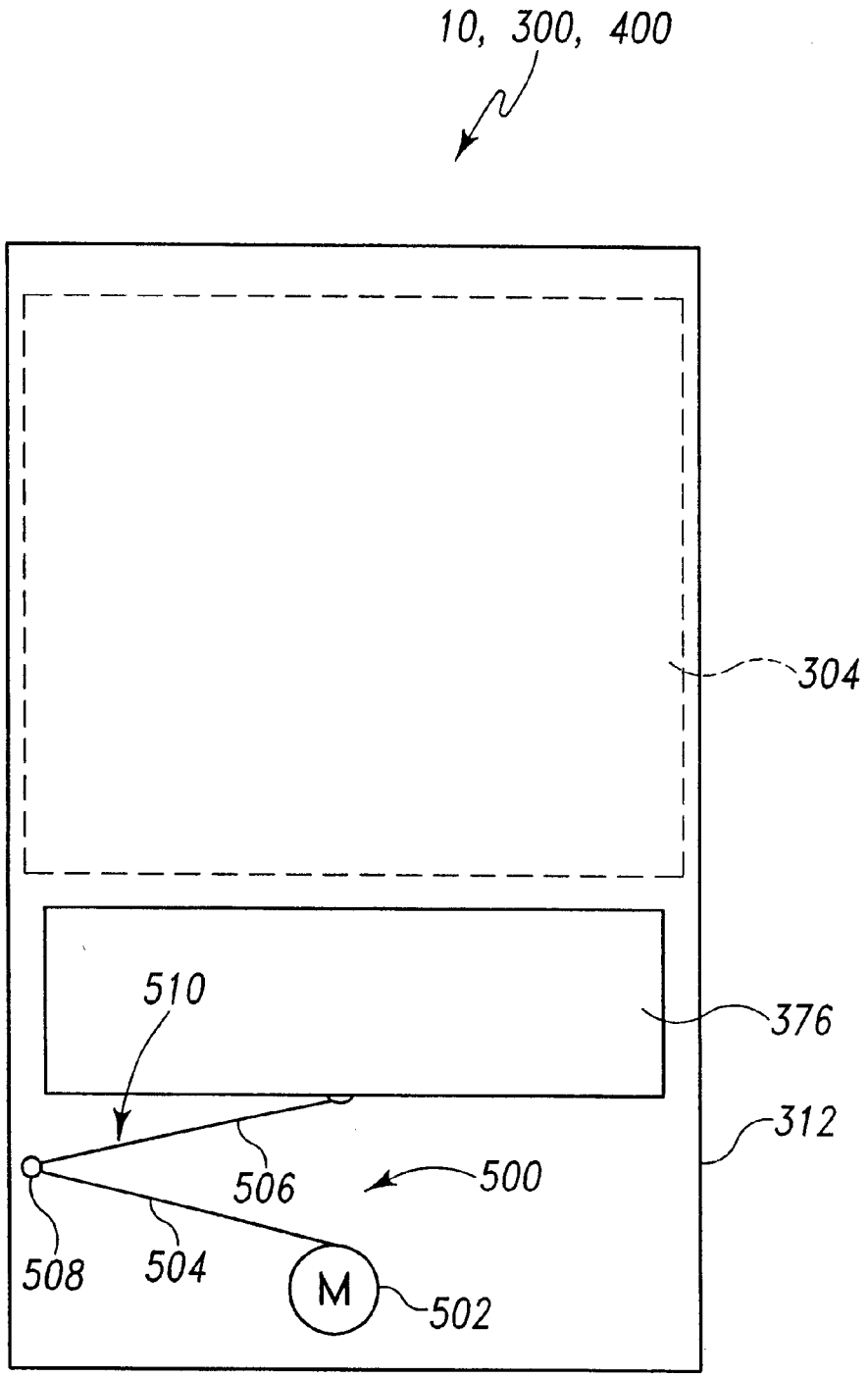
FIG. 16 is a diagrammatic view of an alternative embodiment of a mechanism for moving the bottom stair of the retractable stairs between its extended and retracted stair position, note that the bottom stair is shown positioned in its retracted stair position in FIG. 16.
Figure 17:
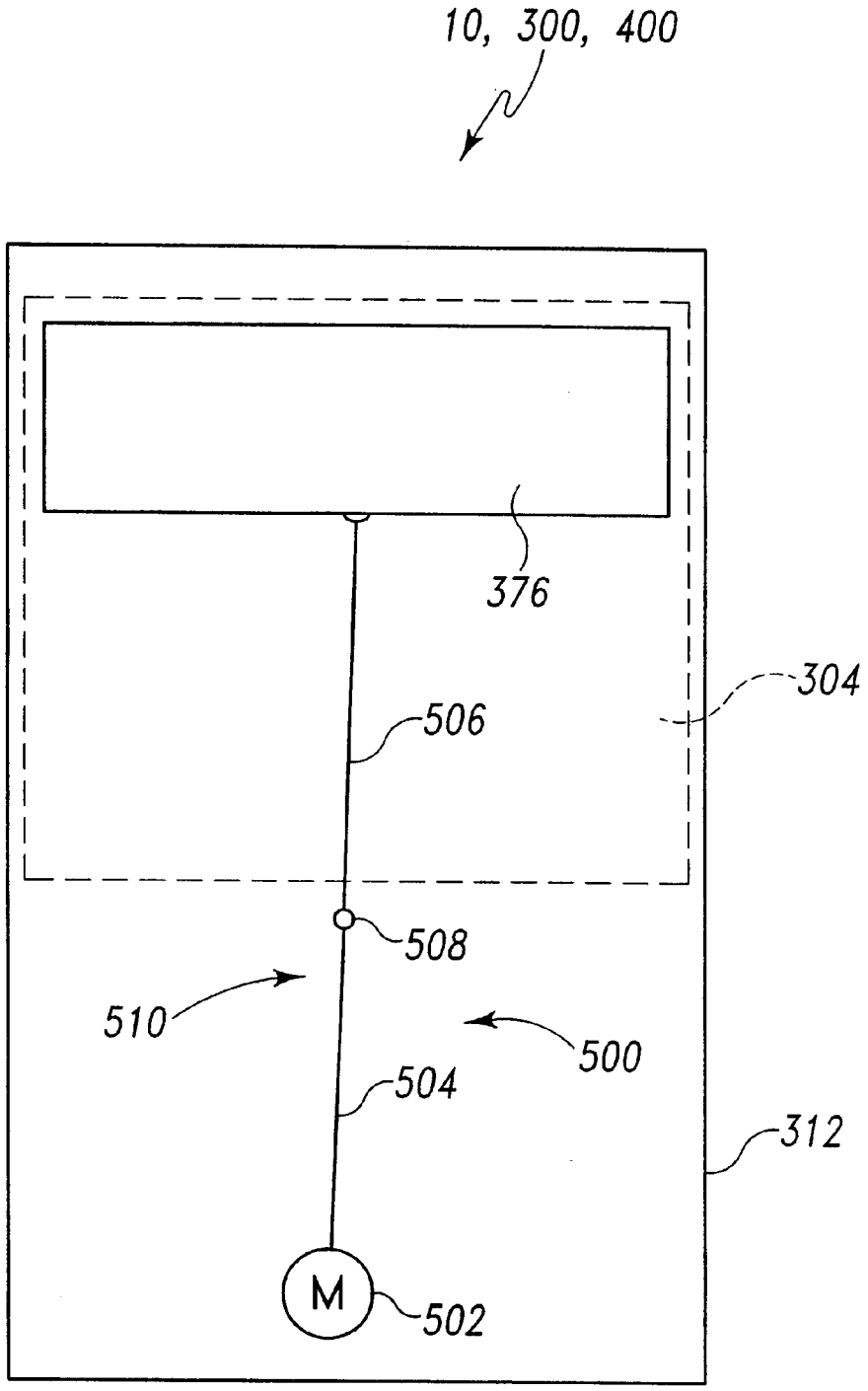
FIG. 17 is a view similar to FIG. 16, but showing the bottom stair positioned in its extended stair position.

Referring now to FIGS. 16 and 17, there is shown an alternative embodiment of a drive mechanism 500 which may be utilized as a source of motive power for moving the bottom stair 376 of any of the previously described embodiments of the convertible lift mechanisms 10, 300, 400. The stair drive mechanism 500 includes a rotary drive motor 502 and a linkage assembly 510. The linkage assembly 510 includes a pair of linkages 504, 506. A first end of the linkage 504 is pivotally coupled to an output of the rotary drive motor 502, whereas a second end of the linkage 504 is pivotally coupled to a first end of the linkage 506 by a pin joint 508. The second end of the linkage 506 is pivotally coupled to the bottom stair 376. The rotary drive motor 502 is somewhat similar in configuration to the motors which are utilized to open and close, for example, a special needs access door of a building or the like.

In particular, actuation of the rotary drive motor 502 in a first direction exerts force on the linkage assembly 510 such that the linkages 504, 506 are moved from the retracted linkage position shown in FIG. 16 to the extended linkage position shown in FIG. 17. Such movement of the linkages 504, 506 causes the bottom stair 376 to be moved from its retracted stair position (as shown in FIG. 16) to its extended stair position (as shown in FIG. 17). It should be appreciated that each of the remaining stairs 302 is likewise moved to their respective extended stair positions during such movement of the bottom stair 376 by the use of contact members such as the flanges and/or lips which interconnect the stairs 302 in a similar manner to as described above in regard to the convertible lift mechanism 10 and the convertible lift mechanism 300.

Conversely, actuation of the rotary drive motor 502 in a second, opposite direction exerts force on the linkage assembly 510 such that the linkages 504, 506 are moved from the extended linkage position shown in FIG. 17 to the retracted linkage position shown in FIG. 16. Such movement of the linkages 504, 506 causes the bottom stair 376 to be moved from its extended stair position (as shown in FIG. 17) to its retracted stair position (as shown in FIG. 16). It should be appreciated that each of the remaining stairs 302 is likewise moved to their respective retracted stair positions during such movement of the bottom stair 376 by the use of flanges and/or lips which mechanically interconnect the stairs 302 in a similar manner to as described above in regard to the convertible lift mechanism 10 and the convertible lift mechanism 300.

Use of the drive mechanism 500 provides the convertible lift mechanisms 10, 300, 400 of the present invention with numerous advantages. Firstly, the drive mechanism 500 is not overly mechanically complex and utilizes relatively few components thereby reducing costs associated with manufacture of the lift mechanisms 10, 300, 400. Moreover, the drive mechanism 500 has a relatively fast cycle time. In particular, the drive mechanism 500 is capable of moving the bottom stair 376 (and hence the remaining stairs 302) between its extended and retracted positions relatively quickly thereby reducing the overall cycle time of the lift mechanism 10, 300, 400.

Accordingly, the present invention provides an improved method and apparatus for lifting a person or an object, such as a personal vehicle, from a lower surface to an upper surface in a low-rise environment. As discussed above, prior art solutions required a substantial amount of additional space to provide facilities for non-ambulatory persons. Not only were the additional space requirements difficult and some times impossible to accommodate at all, even when accommodation was possible, the prior art devices often required alteration of the architectural structure of a facility. By contrast, the method and apparatus of the present invention employs the same footprint for both the stairs and the alternative facilities by either converting one or more stairs to a lift platform or positioning the lift platform under the stairs. The resulting structure has the advantage of requiring substantially less space.

While the invention has been illustrated and described in detail in the drawings and foregoing description, such illustration and description is to be considered as exemplary and not restrictive in character, it being understood that only the preferred embodiments have been shown and described and that all changes and modifications that come within the spirit of the invention are desired to be protected.

There are a plurality of advantages of the present invention arising from the various features of the convertible lift mechanisms described herein. It will be noted that alternative embodiments of the convertible lift mechanisms of the present invention may not include all of the features described yet still benefit from at least some of the advantages of such features. Those of ordinary skill in the art may readily devise their own implementations of a convertible lift mechanism that incorporate one or more of the features of the present invention and fall within the spirit and scope of the present invention as defined by the appended claims.

I claim:

1. A convertible lift mechanism for moving an object from a lower surface to a vertically displaced upper surface, said lower surface and said upper surface having a vertical wall interposed therebetween, said convertible lift mechanism comprising:

a lift platform which is movable between (i) a lowered platform position in which said lift platform is positioned approximately level with the lower surface, and (ii) a raised platform position in which said lift platform is positioned approximately level with said upper surface;

a gate member pivotally secured to said lift platform, said gate member being positionable between (i) an extended gate position in which said gate member is orientated substantially parallel to said lift platform so as to form a bridging surface between said lower surface and said lift platform, and (ii) a retracted gate position in which said gate member is orientated substantially perpendicular to said lift platform so as to form a retaining surface for retaining said object on said lift platform; and a number of retractable stairs, wherein (i) each of said number of retractable stairs includes a substantially horizontal stepping surface, and (ii) each of said number of retractable stairs is horizontally movable between (a) a retracted stair position in which said stepping surface is received into an opening defined in said vertical wall, and (b) an extended stair position in which said stepping surface extends out of said opening defined in said vertical wall.

2. The convertible lift mechanism of claim 1, wherein each of said number of retractable stairs is positioned in said retracted stair position during movement of said lift platform between said lowered platform position and said raised platform position.

3. The convertible lift mechanism of claim 1, wherein:

said gate member is positioned in said extended gate position when said lift platform is positioned in said lowered platform position, and said gate member is positioned in said retracted gate position when said lift platform is positioned in said raised platform position.

4. The convertible lift mechanism of claim 3, wherein said gate member is positioned in said retracted gate position during movement of said lift platform between said raised platform position and said lowered platform position.

5. The convertible lift mechanism of claim 1, further comprising a number of vertical screw drive mechanisms, wherein:

each of said number of vertical screw drive mechanisms includes (i) a drive motor, and (ii) a driven lift nut, each of said driven lift nuts of said number of vertical screw drive mechanisms is secured to said lift platform, and actuation of said drive motors of said number of vertical screw drive mechanisms causes movement of said driven lift nuts thereby moving said lift platform between said lowered platform position and said raised platform position.

6. A method of operating a convertible lift mechanism for moving an object from a lower surface to a vertically displaced upper surface, with (i) said lower surface and said upper surface having a vertical wall interposed therebetween, and (ii) said convertible lift mechanism having (a) a lift platform, (b) a gate member pivotally coupled to said lift platform, and (c) a number of retractable stairs, said method comprising the steps of:

positioning said lift platform in a lowered platform position in which said lift platform is positioned approximately level with the lower surface;

positioning said gate member in an extended gate position in which said gate member is orientated substantially parallel to said lift platform so as to form a bridging surface between said lower surface and said lift platform;

positioning each of said number of retractable stairs in an extended stair position in which a stepping surface associated with each of said number of retractable stairs extends out of an opening defined in said vertical wall;

retracting said stepping surface of each of said number of retractable stairs into said opening defined in said vertical wall so as to position each of said number of retractable stairs into a retracted stair position;

positioning said gate member in a retracted gate position in which said gate member is orientated substantially perpendicular to said lift platform so as to form a retaining surface for retaining said object on said lift platform; and moving said lift platform from said lowered platform position to a raised platform position in which said lift platform is positioned approximately level with said upper surface.

7. The method of claim 6, wherein said step of positioning said lift platform in said lowered platform position is performed prior to said step of positioning each of said number of retractable stairs in said extended stair position.

8. The method of claim 6, wherein said retracting step is performed prior to said moving step.

9. The method of claim 6, wherein said step of positioning said gate member in said retracted gate position is performed contemporaneously with said moving step.

10. The method of claim 6, wherein:

said step of positioning said lift platform in said lowered lift position includes the step of positioning said lift platform below each of said number of retractable stairs, and said retracting step includes the step of retracting said stepping surface of each of said number of retractable stairs into said opening defined in said vertical wall so as to expose said lift platform.

11. The method of claim 6, wherein:

said convertible lift mechanism further has a number of vertical screw drive mechanisms, each of said number of vertical screw drive mechanisms includes (i) a drive motor, and (ii) a driven lift nut, each of said driven lift nuts of said number of vertical screw drive mechanisms is secured to said lift platform, and said moving step includes the step of actuating said drive motors of said number of vertical screw drive mechanisms so as to cause upward movement of said driven lift nuts thereby moving said lift platform from said lowered platform position to said raised platform position.

12. A convertible lift mechanism for moving an object from a lower surface to a vertically displaced upper surface, said lower surface and said upper surface having a vertical wall interposed therebetween, said convertible lift mechanism comprising:

a number of retractable stairs, wherein (i) each of said number of retractable stairs includes a substantially horizontal stepping surface, and (ii) each of said number of retractable stairs is horizontally movable between (a) a retracted stair position in which said stepping surface is received into an opening defined in said vertical wall, and (b) an extended stair position in which said stepping surface extends out of said opening defined in said vertical wall;

a lift platform which is movable between (i) a lowered platform position in which said lift platform is positioned approximately level with the lower surface, and (ii) a raised platform position in which said lift platform is positioned approximately level with said upper surface; and a number of vertical screw drive mechanisms, wherein (i) each of said number of vertical screw drive mechanisms includes a driven lift nut, (ii) each of said driven lift nuts of said number of vertical screw drive mechanisms is secured to said lift platform, and (iii) actuation of said number of vertical screw drive mechanisms causes movement of said driven lift nuts thereby moving said lift platform between said lowered platform position and said raised platform position.

13. The convertible lift mechanism of claim 12, wherein each of said number of retractable stairs is positioned in said retracted stair position during movement of said lift platform between said lowered platform position and said raised platform position.

14. The convertible lift mechanism of claim 12, wherein said lift platform is positioned below each of said number of retractable stairs when (i) said lift platform is located in said lowered platform position, and (ii) said stepping surface of each of said number of retractable stairs is positioned in said extended stair position.

15. The convertible lift mechanism of claim 12, wherein:

said lift platform is rectangular in shape, said number of vertical screw drive mechanisms includes a first screw drive mechanism, a second screw drive mechanism, a third screw drive mechanism, and a fourth screw drive mechanism, said driven lift nut of said first screw drive mechanism is secured to a first comer portion of said lift platform, said driven lift nut of said second screw drive mechanism is secured to a second comer portion of said lift platform, said driven lift nut of said third screw drive mechanism is secured to a third corner portion of said lift platform, and said driven lift nut of said fourth screw drive mechanism is secured to a fourth comer portion of said lift platform.

16. The convertible lift mechanism of claim 12, further comprising a number of linear actuators, wherein:

each of said number of retractable stairs has one of said number of linear actuators secured thereto, and actuation of said number of linear actuators causes movement of said number of retractable stairs between said retracted stair position and said extended stair position.

17. A convertible lift mechanism for moving an object from a lower surface to a vertically displaced upper surface, said lower surface and said upper surface having a vertical wall interposed therebetween, said convertible lift mechanism comprising:

a lift platform which is movable between (i) a lowered platform position in which said lift platform is positioned approximately level with the lower surface, and (ii) a raised platform position in which said lift platform is positioned approximately level with said upper surface;

a first retractable stair having a first substantially horizontal stepping surface, said first retractable stair being horizontally movable between (i) a first retracted stair position in which said first stepping surface is received into an opening defined in said vertical wall, and (ii) a first extended stair position in which said first stepping surface extends out of said opening defined in said vertical wall;

a second retractable stair having a second substantially horizontal stepping surface, said second retractable stair being horizontally movable between (i) a second retracted stair position in which said second stepping surface is received into said opening defined in said vertical wall, and (ii) a second extended stair position in which said second stepping surface extends out of said opening defined in said vertical wall; and a contact member secured to said first retractable stair, wherein (i) said contact member contacts said second retractable stair during movement of said first retractable stair from said first retracted stair position to said first extended stair position so as to urge said second retractable stair into said second extended stair position, and (ii) said contact member contacts said second retractable stair during movement of said first retractable stair from said first extended stair position to said first retracted stair position so as to urge said second retractable stair into said second retracted stair position.

18. The convertible lift mechanism of claim 17, further comprising a source of motive force, wherein said source of motive force is operatively coupled to said first retractable stair so as to move said first retractable stair between said first extended stair position and said first retracted stair position.

* * * * *